US010175025B1

(12) United States Patent
Fehringer

(10) Patent No.: US 10,175,025 B1
(45) Date of Patent: Jan. 8, 2019

(54) CROSSBOW COCKING APPARATUS

(71) Applicant: Daniel John Fehringer, Coeur d'Alene, ID (US)

(72) Inventor: Daniel John Fehringer, Coeur d'Alene, ID (US)

( * ) Notice: Subject to any disclaimer, the term of this patent is extended or adjusted under 35 U.S.C. 154(b) by 0 days.

(21) Appl. No.: 15/530,297

(22) Filed: Dec. 20, 2016

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12; F41B 5/123
See application file for complete search history.

(56) References Cited

U.S. PATENT DOCUMENTS 4,719,897 A 1/1988 Gaudreau
5,243,956 A 9/1993 Luehring
6,095,128 A 8/2000 Bednar
6,874,491 B2 2/2005 Bednar
7,624,725 B1 12/2009 Choma
8,439,024 B2 * 5/2013 Barnett ..... F41B 5/1469 124/25
8,573,192 B2 * 11/2013 Bednar ..... F41B 5/1469 124/25
9,285,182 B2 * 3/2016 Bednar ..... F41B 5/1469
9,335,115 B2 * 5/2016 Bednar ..... F41B 5/123

* cited by examiner

*Primary Examiner* — John Ricci
(74) *Attorney, Agent, or Firm* — Reidlaw, L.L.C.; John S. Reid

(57) ABSTRACT

A bow-cocking apparatus includes a cocking cord having first and second ends. A first cocking cord handle and a second cocking cord handle are attached to the respective first and second ends of the cocking cord. The apparatus further includes first and second cocking cord connectors, and an elongate spring member. The elongate spring member is anchored at first and second ends thereof to the respective first and second cocking cord connectors. Each cocking cord connector includes a spindle which supports rotation of the cocking cord about the spindle, each cocking cord connector and each respective spindle defining a cocking cord opening sized to allow the cocking cord to move freely there-through. Each cocking cord connector includes a cocking hook to engage a bowstring. The cocking cord passes through the first and second cocking cord openings in the respective first and second cocking cord connectors.

20 Claims, 21 Drawing Sheets

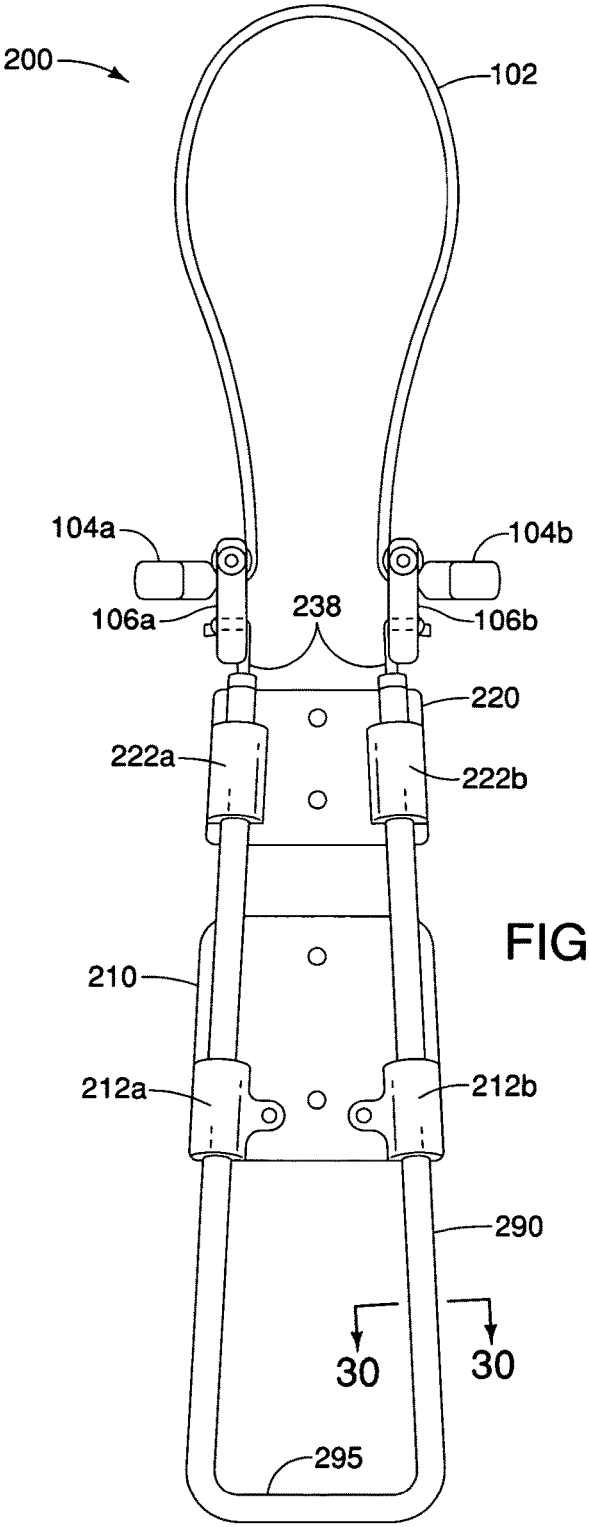
FIG. 29
FIG. 30
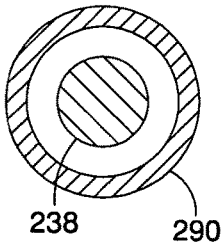

CROSSBOW COCKING APPARATUS

BACKGROUND

In order to tension the bowstring and limbs of a crossbow in advance of shooting a crossbolt (or bolt), a user typically uses a bow-cocking device to facilitate drawing the bowstring, as opposed to manually drawing the bowstring using the fingers alone. This is due to the high draw weight (up to 250 lb of force, or more) of most crossbows in conjunction with the relatively short length of the crossbow limbs (as compared to a recurve bow, for example) which reduces leverage. While some crossbows are provided with cam systems to facilitate drawing the bowstring and allowing for higher draw weights, such compound crossbows can be considerably more expensive than a traditional (non-compound) crossbow. Further, crossbows are frequently provided with an optical scope which is mounted in the area where the bowstring is engaged by the latch, making it difficult for a users fingers to engage the bowstring in the latch. Several bow-cocking devices are known. One such device (as described in U.S. Pat. No. 6,095,128) provides crank mechanism (which can be actuated either manually or electrically) for drawing the bowstring. Such crank-cocking devices typically need to be incorporated as an integral part of the crossbow. A more common bow-cocking device is depicted in U.S. Pat. No. 7,624,725. This latter device includes a continuous rope or cord, two connectors, and two handles attached at opposite ends of the cord. The connectors each include a hook, to engage a bowstring, and a pulley. The cord passes through the pulleys on the connectors, and further passes around the shoulder of the stock (where the stock joins the main body or frame of the crossbow). The device is thus a separate unit from the crossbow, and must be carried separately from the crossbow. The advantage of this latter style of bow-cocking device is that the handles attached to the cord allow the forces necessary for drawing the bowstring to be reduced by 50% and distributed over a wider area of the users fingers, thus reducing pressure on the users fingers. A disadvantage of this device is that, being a separate unit from the crossbow, it can be lost and become tangled during storage.

BRIEF DESCRIPTION OF THE DRAWINGS

FIG. 29 is a plan view of an alternative bow-cocking apparatus according to the present disclosure.

FIG. 30 is a cross section of a retraction cord tube according to the bow-cocking apparatus depicted in FIG. 29.

DETAILED DESCRIPTION

The present disclosure provides for one or more crossbow cocking apparatuses which can be used to assist a user in drawing the bowstring of a crossbow. The apparatuses provided for herein can be provided either as an accessory apparatus (which can be used with many existing crossbows), or as an integral unit with a crossbow. In general, the crossbow cocking apparatuses of the present disclosure provide for: (i) a cocking cord, bow-cocking hooks, and cocking handles, which, together, can be used to draw the bowstring into a latch in the crossbow, and which can be mounted onto the crossbow; and (ii) and a retraction device which can retract the bow-cocking hooks, and the cocking handles, to a stored position on the bow following cocking of the bowstring. The present disclosure thus provides for a bowstring cocking device which can be mounted directly onto a crossbow (thus eliminating the problems associated with storing the bowstring cocking apparatus separately from the crossbow between uses of the apparatus), while also providing for a means for conveniently positioning the cocking handles and the bow-cocking hooks in a stored position which are out of the way of the user when firing a bolt from the crossbow.

Figure 12:
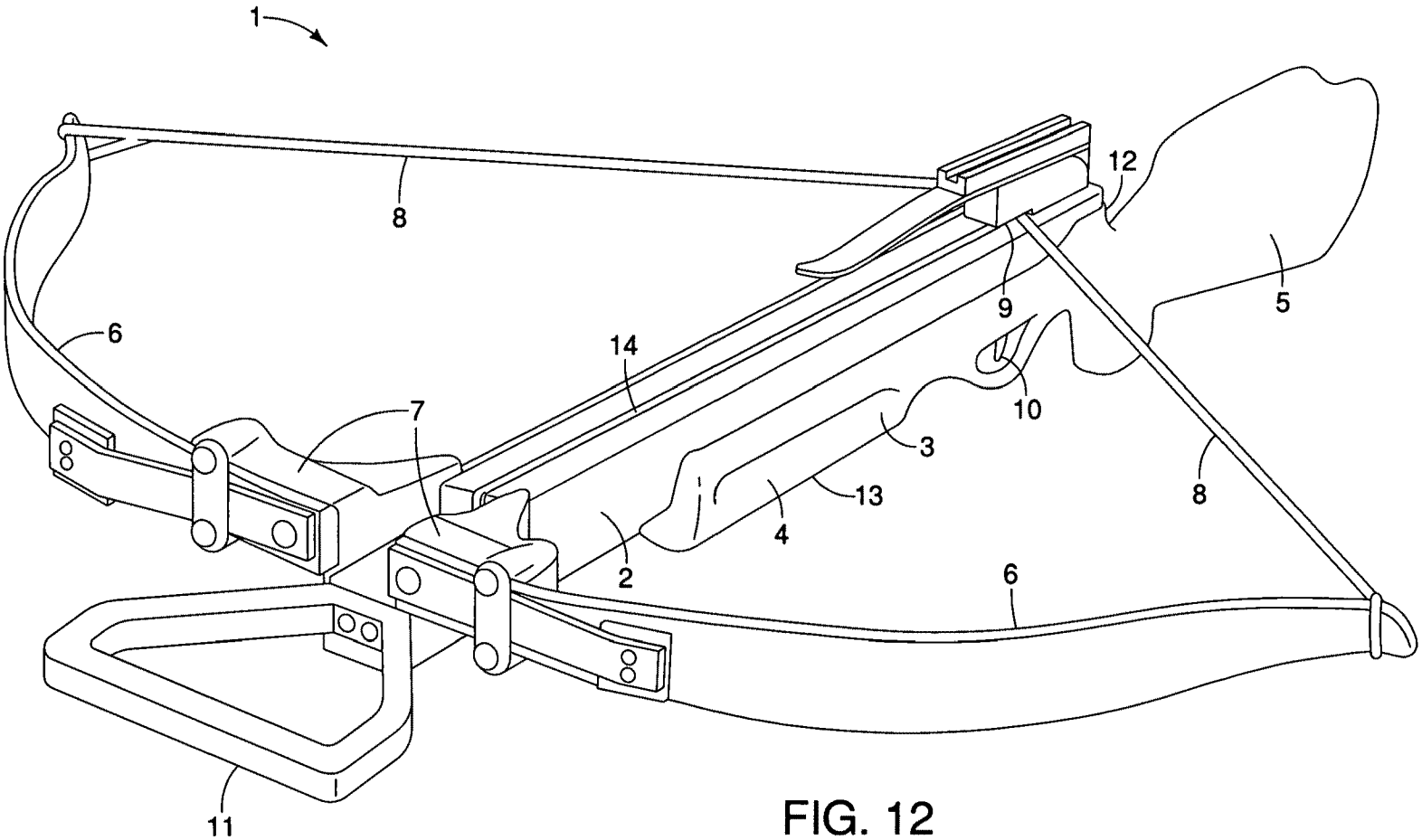
FIG. 12 Prior Art
FIG. 12 is an isometric view of a prior art crossbow, depicting elements common to most crossbows.

Briefly turning to FIG. 12, this figure depicts a generic crossbow 1 in an isometric view. FIG. 12 is primarily provided for the purposes of establishing common nomenclature with respect to a wide variety of prior art crossbows. The crossbow 1 of FIG. 12 includes a barrel 2 which is used to guide the forward progress of a bolt (not shown) from the crossbow by way of a flight groove 14. (Flight groove 14 engages a fletching, or feature, on the bolt.) The barrel 2 of the crossbow 1 is supported by a frame 3, which includes a foregrip 4 and a stock 5. The foregrip 4 defines an underside of the frame 13. The crossbow 1 further includes limbs 6, which are attached to the barrel 2 by way of risers 7. A bowstring 8 is attached to opposite outward ends of the limbs 6. When the bowstring 8 is positioned in a drawn position (as depicted in FIG. 12), the bowstring is engaged by a latch 9. The latch 9 can be released by the trigger 10, thus allowing the bowstring 8 and the bolt (not shown) to move forward along the flight groove 14. The frame 3 is defined by a frame underside 13, which can be provided with mounting holes or other mounting features (not shown) to allow accessories to be mounted to the frame underside 13. Crossbow frames are typically provided with threaded insert features which allow the mounting on the underside 13 of the frame 3 with accessories such as: (i) a bolt storage rack; and (ii) a bipod stand. The crossbow 1 of FIG. 12 is further depicted as including a cocking stirrup 11. The cocking stirrup 11 can be used to facilitate in cocking the crossbow (as described more fully below). Of note the frame 3, either separately or in conjunction with the barrel 2, forms a shoulder 12.

Figure 1:
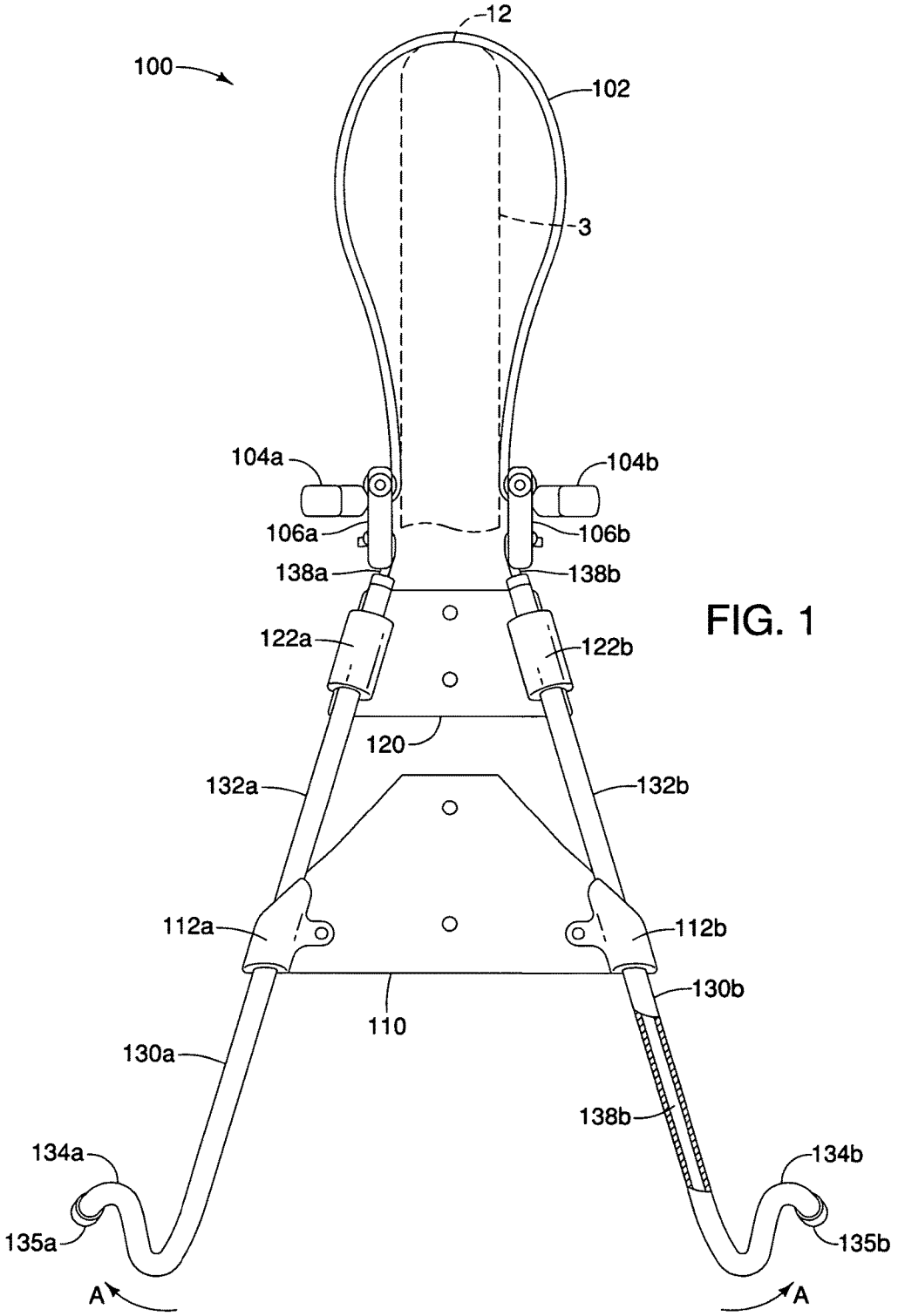
FIG. 1 is a top plan view of a bow-cocking apparatus according to one embodiment of the disclosure provided for herein.
Figure 2:
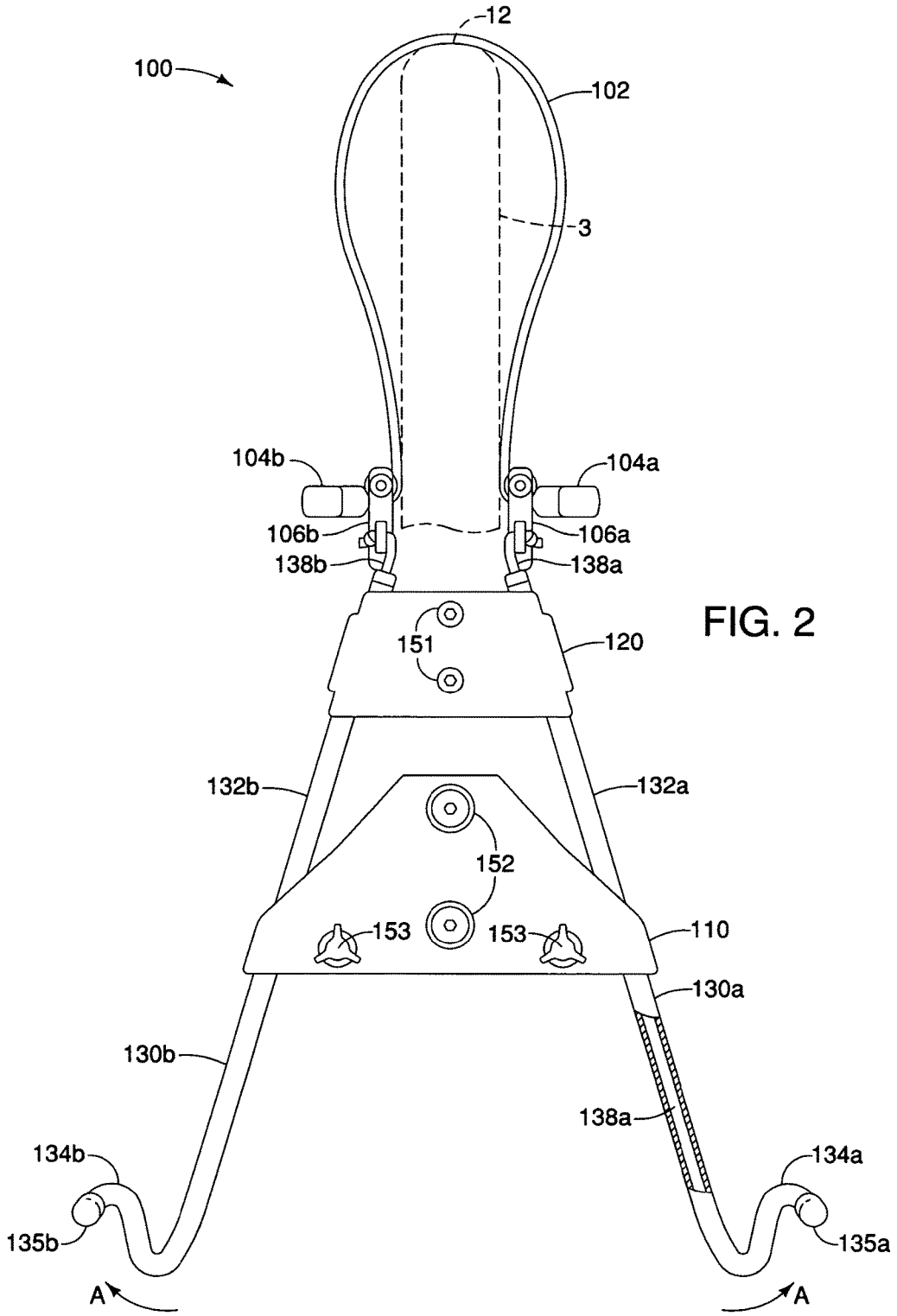
FIG. 2 is a bottom plan view of the bow-cocking apparatus depicted in FIG. 1.

A first embodiment of a crossbow cocking apparatus 100, in accordance with the present disclosure, is depicted in the top plan view of FIG. 1, the bottom plan view of FIG. 2, and additionally at least in FIGS. 3-8. (The views in FIGS. 1 and 2 are provided in a slight isometric presentation to better show the component parts.) The crossbow-cocking apparatus 100 of FIG. 1 is configured as an accessory device which can be used with a large number of prior art crossbows, as will be described further below. I will first identify the main components of the apparatus 100, and will then describe their assembly into the apparatus, followed by a description of the use of the apparatus. While the apparatus (and variations thereof) described herein are particularly suited for use with crossbows (including compound crossbows), and can thus be described as a crossbow-cocking apparatus, it will be appreciated that the apparatus can also be used with other types of bows (such as a non-crossbow compound bow), and can thus be generally described as a bow-cocking apparatus.

With reference to FIGS. 1 and 2, the crossbow cocking apparatus 100 includes a forward (or front) mounting bracket 110 and a rear mounting bracket 120, both of which are configured to be mounted on the underside (13) of a crossbow frame (3) and/or barrel (2)—(see FIG. 12 for crossbow components). The apparatus 100 further includes hollow leg members 130*a* and 130*b*, which are supported by the front and rear mounting brackets (110, 120). The apparatus 100 also includes the following components: (i) a cocking cord 102; (ii) cocking handles 104*a* and 104*b* which are attached to opposite ends of the cocking cord 102; (iii) cocking cord connectors (also described herein as cocking connectors, cocking cord connectors, or cocking hooks) 106*a* and 106*b*; and (iv) cocking connector retraction cords 138*a* (FIG. 2) and 138*b* (FIG. 1), which are primarily disposed within the respective hollow leg members 130*a* and 130*b*.

Figure 4:
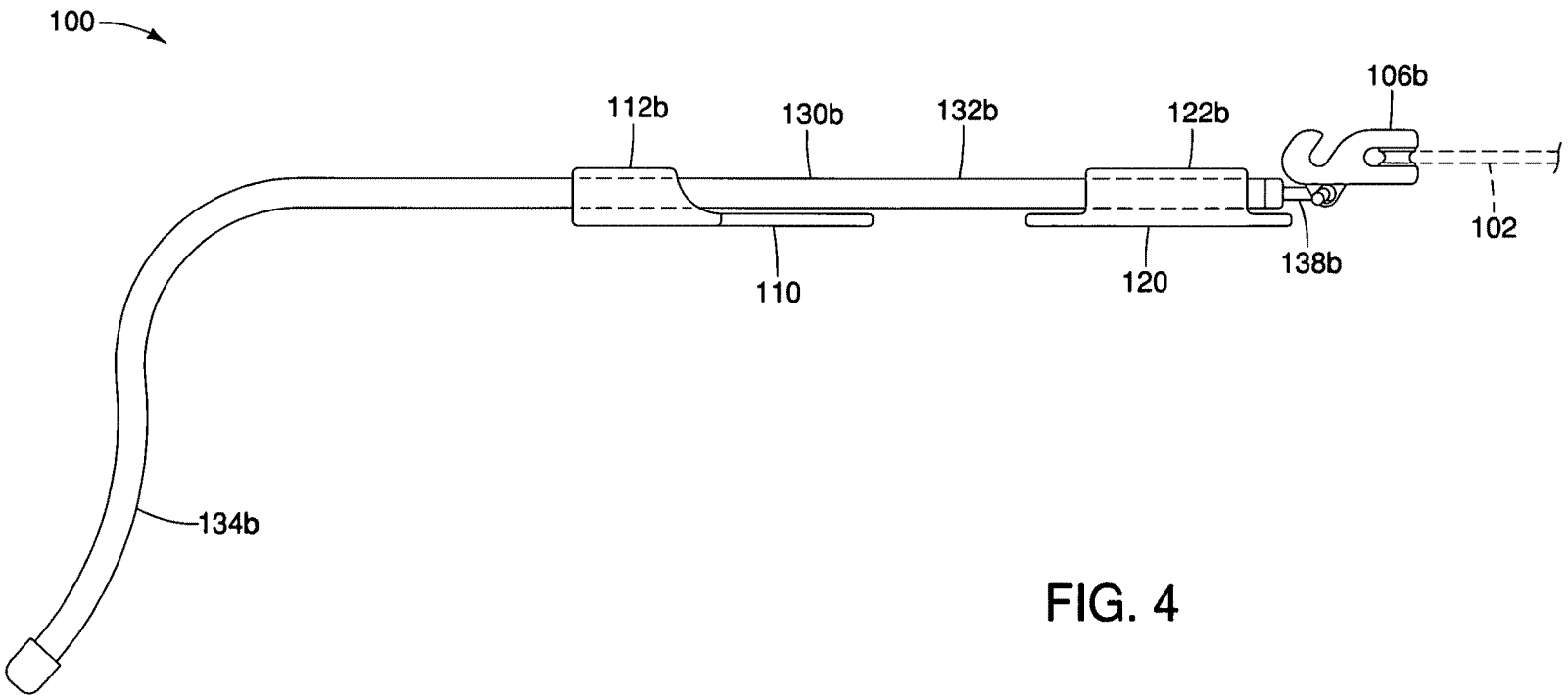
FIG. 4 is a right side view of the bow-cocking apparatus depicted in FIG. 1.

FIG. 4 is a partial right side view of the apparatus 100 of FIG. 1, showing only a portion of the cocking cord 102 in phantom view to facilitate viewing of the cocking connector 106*b*. In FIG. 4 it is seen how the leg member 130*b* is supported by the front mounting bracket 110 by a front leg hinge member 112*b*, and further supported by the rear mounting bracket 120 by rear leg hinge member 122*b*. A left side view of the apparatus 100 is essentially the same as the right side view depicted in FIG. 4, except showing leg member 130*a* and leg hinge members 112*a* and 112*b*. The right side view of FIG. 4 also allows a clearer viewing of the cocking connector 106*b* than is provided in either FIG. 1 or 2.

Figure 3:
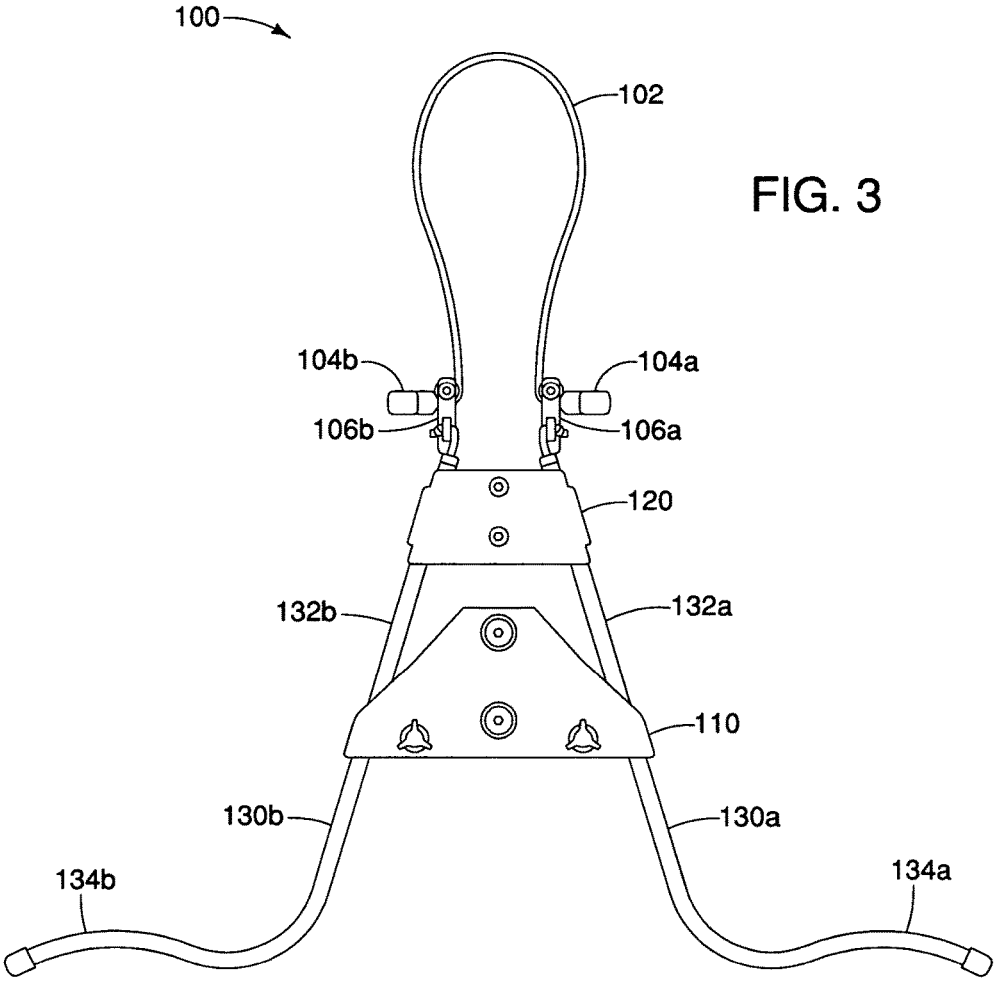
FIG. 3 is another plan view of the bow-cocking apparatus depicted in FIGS. 1 and 2, but depicting support legs of the apparatus rotated to a stored position.
Figure 4A:
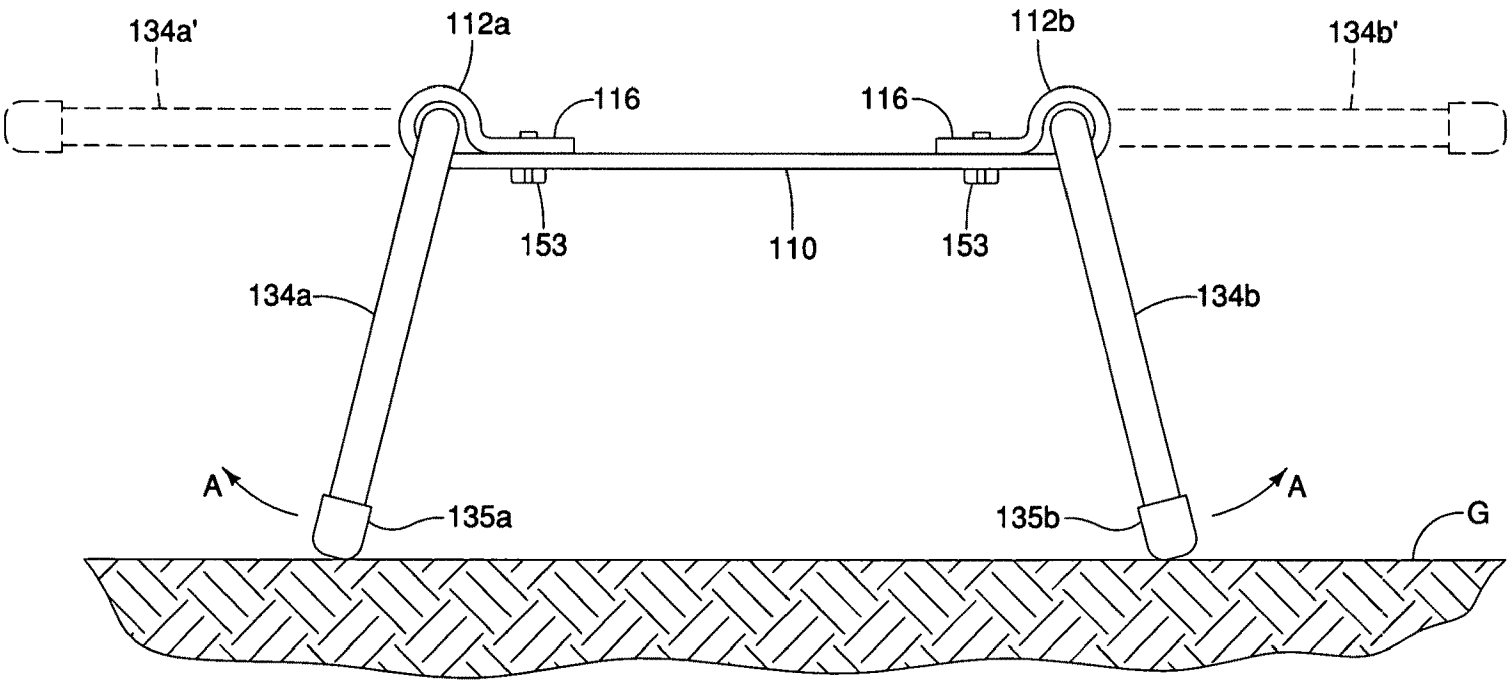
FIG. 4A is a front view of the bow-cocking apparatus depicted in FIGS. 1 and 4.

As indicated above in FIG. 4 (and the accompanying description) and in FIG. 1, leg members 130*a* and 130*b* are supported by the front mounting bracket 110 by respective leg hinge members 112*a* and 112*b*, and by the rear mounting bracket 120 by respective leg hinge members 122*a* and 122*b*. The leg members 130*a* and 130*b* can thus rotate within the leg hinge members (112*a*, 122*a*, and 112*b*, 122*b*), as indicated by directional arrows "A" in FIG. 1. That is, leg members 130*a* and 130*b* can rotate from the deployed position (depicted in FIGS. 1, 2 and 4) to a stored position as depicted in FIG. 3. (FIG. 3 is a bottom plan view similar to FIG. 2, but showing the leg members 130*a* and 130*b* rotated in directions "A" from the deployed positions depicted in FIG. 2 to the stored position.) As depicted in FIG. 3, the leg members 130*a* and 130*b* can include respective generally straight leg segments 132*a* and 132*b* (which extend outward (forward) from the front mounting bracket 110), and respective curvilinear leg segments 134*a* and 134*b* (which extend from the respective straight leg segments 132*a* and 132*b* to the terminus of the leg members at respective feet 135*a* and 135*b*). The term "generally straight leg segment" means that the ends of such a leg segment does not vary by more than about one-half inch from a straight line. The curvilinear leg segments 134*a*, 134*b* of the respective leg members 130*a*, 130*b* are oriented at an angle of between about 75 degrees and 120 degrees from the respective generally straight leg segments 132*a*, 132*b*. In FIG. 4 the curvilinear leg segment 134*b* of the leg member 130*b* is depicted as being oriented at an angle of about 90 degrees from the respective generally straight leg segment. Leg member 130*a*, not visible in FIG. 4, can be configured similarly. FIG. 4A is a front view of the apparatus 100, depicting the curvilinear segments 134*a*, 134*b* of the leg members (130*a*, 130*b*, FIG. 2) in solid line, resting on a ground surface "G", as well as in phantom line (134*a*', 134*b*') indicating the retracted position of the leg members. In plan view the leg members 130*a*, 130*b* are preferably positioned in a splayed-apart relationship from one another (generally splaying outward from one another as they move away from the front and rear mounting brackets (110, 120, FIG. 1), as indicated by the positions of the leg mounting hinge brackets 112*a*, 112*b* (for front mounting bracket 110), and 122*a*, 122*b* (for rear mounting bracket 120). The angle of splay between the leg members 130*a* and 130*b* is preferably in the range of about 15 degrees to about 45 degrees, and more preferably between about 25 degrees and 30 degrees. The advantage of splaying the leg members 130*a*, 130*b* apart from one another is that, when the leg members are rotated to a deployed position (as indicated in FIG. 4A), it will provide an increase distance between the leg member feet (135*a* and 135*b*), thus providing a more stable platform for supporting the attached crossbow. Further, by splaying the leg members 130*a*, 130*b* apart from one another, the ends of the retraction cord 138*a*, 138*b* that are attached to the respective cocking cord connectors 106*a*, 106*b* are also splayed-apart from one another. The leg members 130*a*, 130*b* can be fabricated from materials such as hollow aluminum tubing and hollow stainless steel tubing. Preferably the material of construction of the leg members 130*a*, 130*b* is selected to resist bending forces imparted to the leg members by elongation of the retraction cords 138*a*, 138*b*.

Figure 5:
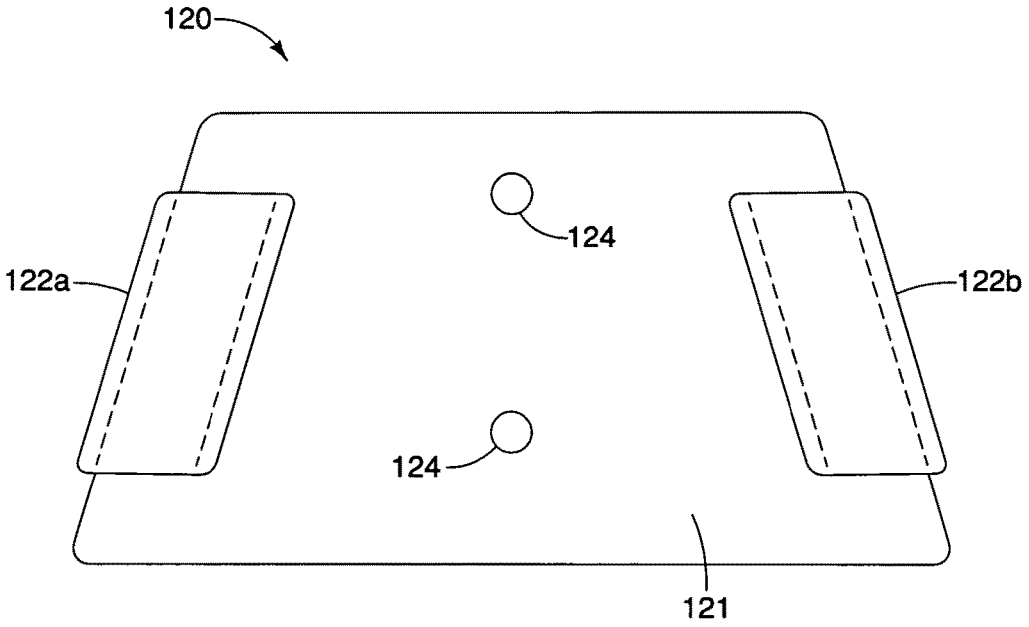
FIG. 5 is a top plan view of a rear mounting bracket used in the bow-cocking apparatus depicted in FIGS. 1 and 2.
Figure 6:
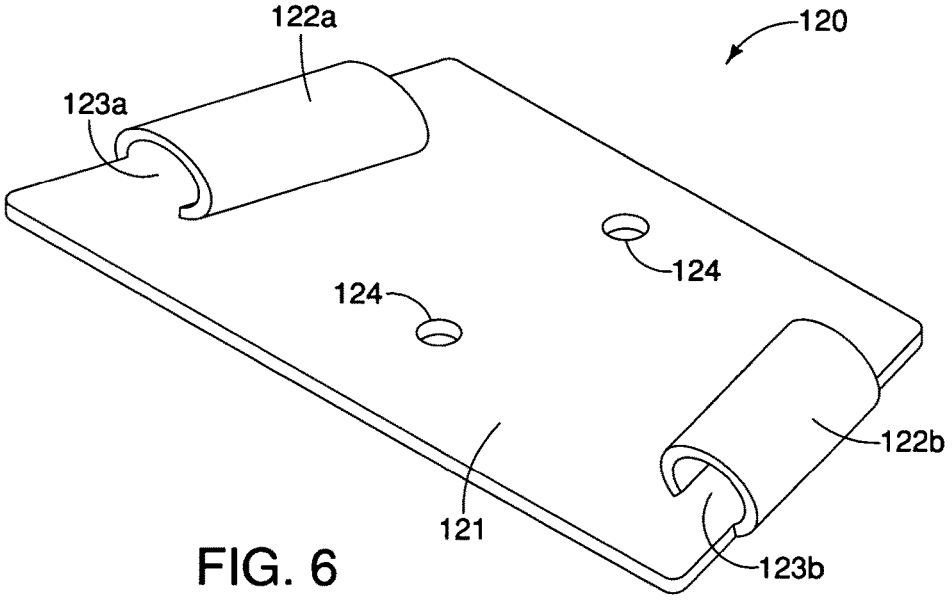
FIG. 6 is an isometric view of the rear mounting bracket depicted in FIG. 5.

FIG. 5 is a top plan view of the rear mounting bracket 120, and FIG. 6 is an isometric view of the rear mounting bracket of FIG. 5. In this example the rear mounting bracket 120 is fabricated from sheet material (such as stainless steel, for example), and includes a central rear bracket plate 121 and leg member mounting hinge brackets 122*a*, 122*b*. The central rear bracket plate 121 can be provided with rear bracket mounting holes 124 to allow the rear mounting bracket to be attached to the underside of a crossbow frame (underside 13 of frame 3, FIG. 12).

Figure 7:
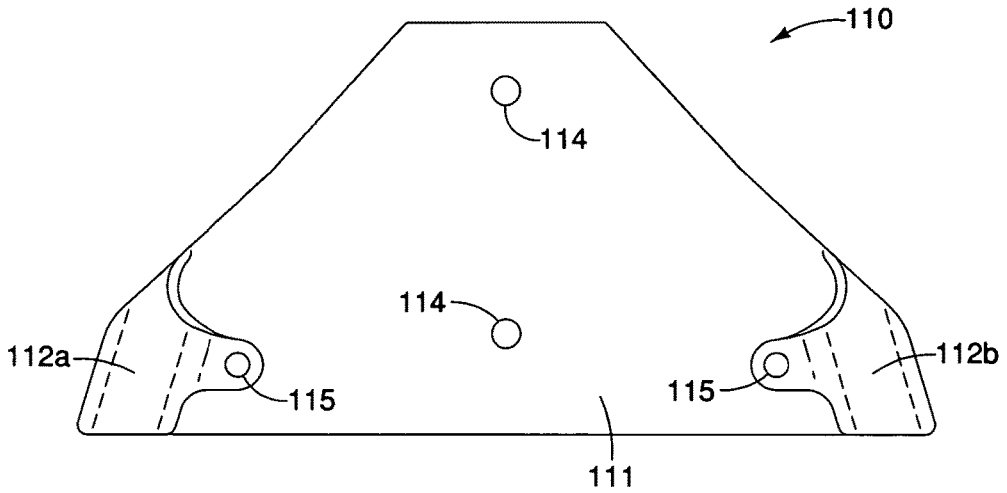
FIG. 7 is a top plan view of a front mounting bracket used in the bow-cocking apparatus depicted in FIGS. 1 and 2.
Figure 8:
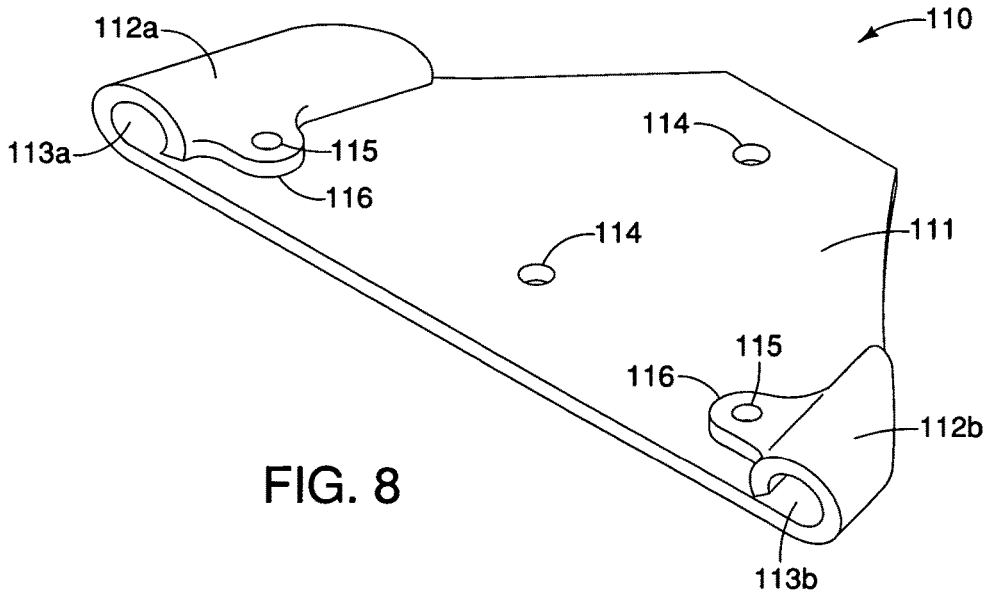
FIG. 8 is an isometric view of the front mounting bracket depicted in FIG. 7.

FIG. 7 is a top plan view of the front mounting bracket 110, and FIG. 8 is an isometric view of the front mounting bracket of FIG. 7. In this example the front mounting bracket 110 is fabricated from sheet material (such as stainless steel, for example), and includes a central front bracket plate 111 and leg member mounting hinge brackets 112*a*, 112*b*. The central front bracket plate 111 can be provided with front bracket mounting holes 114 to allow the front mounting bracket to be attached to the underside (13) of the crossbow frame (3, FIG. 12). The front bracket leg hinge members 112*a*, 112*b* can include leg tensioning members 116 which are provided with tensioning member holes 115. Turning back to FIG. 4A (and further with reference to FIG. 1) it can be seen that the leg members 130*a*, 130*b* are captured by the respective front leg hinge members 112*a*, 112*b*, and that leg member tensioning screws (depicted as thumbscrews 153 in FIG. 4A) inserted through holes 115, FIG. 8) can be used to bring the leg tensioning members 116 into proximity to the central front bracket plate 111, thus clamping the leg members firmly within the front leg hinge members. To loosen the leg members 130*a*, 130*b* within the front leg hinge members 112*a*, 112*b*, the user can loosen the thumbscrews 153, thus allowing the leg members to be moved from the positioned depicted in FIG. 2 to the positions depicted in FIG. 3, and any positions in between. Other means of allowing the leg hinge members 112*a*, 112*b* to be tightened and loosened (to thus allow the leg members to be fixed in the leg hinge members, or free to rotate within the leg hinge members) can be used in place of the thumbscrews 153 (e.g., clamping devices), and I will generally refer to any means which can be used to tighten or loosen the leg members within the leg hinge members as a leg member tensioning device.

While FIGS. 1-4 depict the apparatus 100 as having two mounting brackets (110, 120), a single mounting bracket can be employed (either front bracket 110, rear bracket 120, or a modified version of either bracket, include one continuous bracket that includes the features of brackets 110 and 120). The advantage of having two mounting brackets (110, 120, as depicted in the example of FIG. 1) is that this allows the user greater flexibility when mounting the apparatus 100 to a crossbow. As indicated above, the underside (13) of a crossbow frame (3, FIG. 12) is typically provided with several mounting features (such as threaded holes) which can be used with the mounting holes (114 of front bracket 110, FIG. 8, and 124 of the rear bracket 120, FIG. 6). The brackets (110, 120) can thus be attached to the crossbow frame with machine screws or bolts, using the crossbow's existing mounting features. Alternately, since the frames of most crossbows are manufactured from materials such as wood or a composite material, the underside of the crossbow frame can be provided with mounting features to match the bracket mounting holes (114, 124, FIGS. 5 and 7) in the mounting brackets (110, 120). This can be done by drilling a mounting feature hole into the underside of the crossbow frame, and then press-fitting a mounting feature (such as a female threaded insert) into the mounting feature hole. In one variation the crossbow cocking apparatus 100 can be mounted to the underside of the crossbow frame using a universal rail mounting system. One example of a universal rail mounting system is the Picatinny rail system (also known as a MIL-STD-1913 rail, Standardization Agreement 2324 rail, or tactical rail), which includes a mounting rail and rail mounting brackets which can be attached to the rail. In this variation the rail can be mounted to the underside of the crossbow frame using existing mounting features (typically, female threaded inserts), and rail mounting brackets can be attached to the crossbow cocking apparatus mounting brackets (110, 120) using the bracket mounting holes (114, 124). The cocking mounting brackets (110, 120) can then be slid onto the rail using the rail mounting brackets. It will be appreciated that other means for securing the crossbow cocking apparatus 100 to a crossbow can be employed, such as by the use of clamps, wood screws, press-fit fasteners, and even gluing or welding (e.g., welding metal mounting brackets to the typically metal barrel of the crossbow). In general, the crossbow cocking apparatus 100 can be secured to a crossbow (e.g., crossbow 1 of FIG. 12) using any such securing means. Preferably the securing means holds the crossbow cocking apparatus 100 securely to the crossbow.

As indicated above, the crossbow cocking apparatus provided for herein includes a retraction device which can retract the bow-cocking hooks (e.g., 106*b*, FIG. 4), and the cocking handles (104*a*, 104*b*), to a stored position on the crossbow following cocking of the bowstring. The retraction device is preferably attached to each cocking hook. The retraction device includes an elongate spring member that can be stretched from a first length to a second longer length in order to impose a tensile force in the retraction device. This tensile force is used to restore the bow-cocking hooks and the cocking handles to the stored position. The retraction device is configured to have sufficient elongation capability that the cocking handles can be moved a distance required to allow the bowstring to engage the cocking latch. The retraction device can be configured to impart a retraction force of between about 5 pounds force and 20 pounds force on each cocking hook when extended to the length which allows the bowstring to be engaged by the latch. In one variation (depicted in FIGS. 1, 2 and 4) the retraction device includes two separate elongate spring members (138*a*, 138*b*). In another variation (depicted in FIGS. 29 and 32) the retraction device includes a single elongate spring member (238). The elongate spring member can be provided, by way of example only, as: (i) an elasticized cord member; (ii) a rubber member having elastic spring properties; or (iii) an elongate coil spring. The elongate spring member can have, by way of example only, a spring constant of between about 0.3 and 1.5 pounds-force per inch of elongation.

Figure 13:
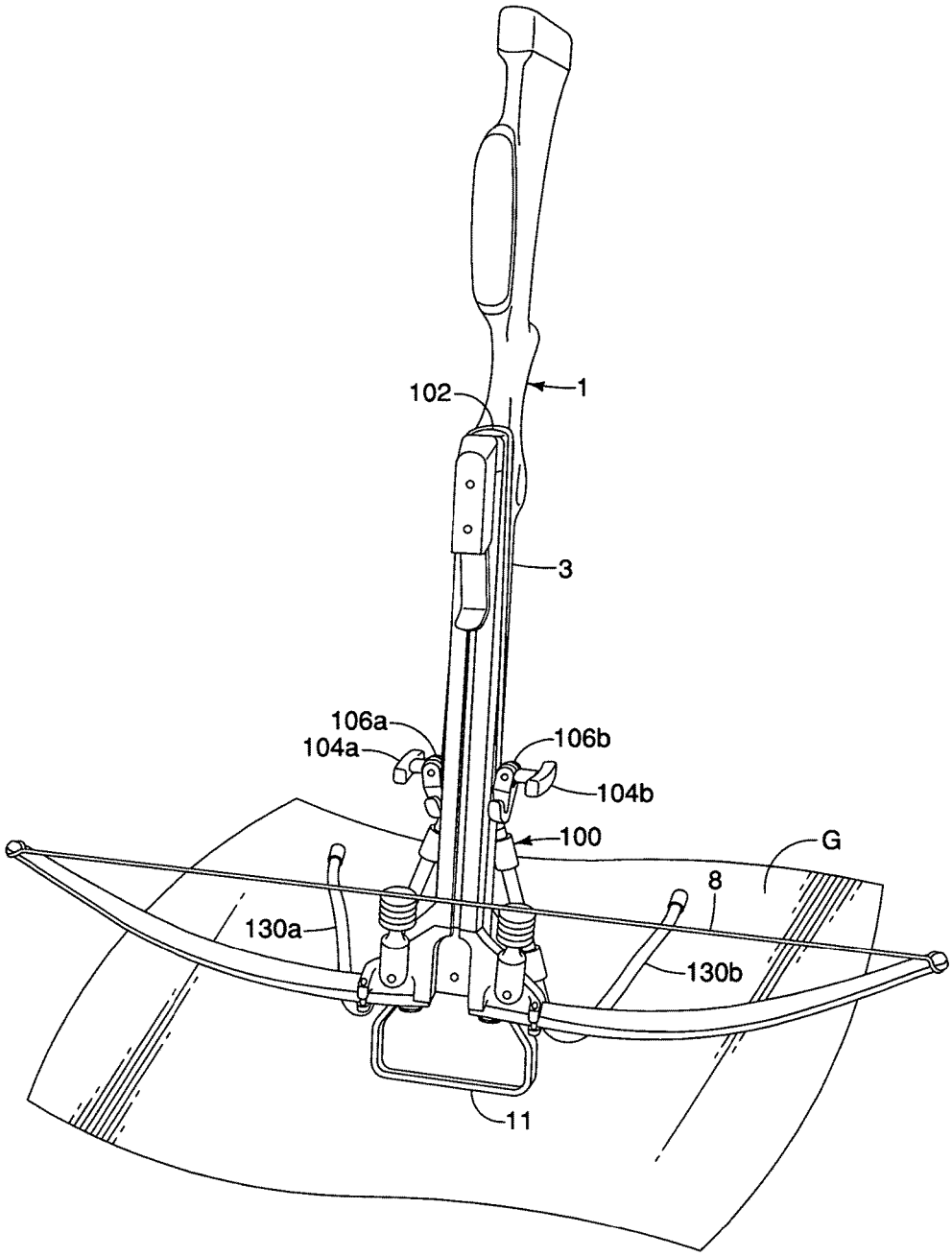
FIG. 13 is a plan view (with slight isometric presentation) of a prior art crossbow with a bow-cocking apparatus of the present disclosure mounted thereto.

In the example depicted in FIGS. 1, 2 and 4, the retraction device includes retraction cords 138*a* and 138*b*, which are primarily housed within the respective hollow leg members 130*a* and 130*b*. Each retraction cord 138*a*, 138*b* is defined by a first end which is connected to a respective cocking hook 106*a*, 106*b*, and a second end which is secured at the terminus of the leg members 130*a*, 130*b* (proximate the feet 135*a*, 135*b*). For example, the retraction cords 138*a*, 138*b* can be knotted outside of the respective leg members 130*a*, 130*b*, and the knots can be covered by respective feet or caps 135*a*, 135*b*. In this example the retraction cords 138*a*, 138*b* are elasticized cord segments which can be stretched in order to allow the cocking hooks 106*a*, 106*b* to be pulled away from the stored position (i.e., the position indicated in FIGS. 1, 2 and 4). Turning briefly to FIG. 13, a prior art crossbow 1 is depicted in plan view (with a slight isometric presentation), along with the crossbow cocking apparatus 100 mounted to the frame 3 of the crossbow. FIG. 13 shows how the retraction cords (138*a*, 138*b*, FIGS. 1 and 2, not visible in FIG. 13) hold the bow-cocking handles 104*a*, 104*b* (which are attached to the cocking cord 102), and the cocking hooks 106*a*, 106*b*, in a stored position close to the sides of the crossbow frame 3. Additional discussion of the retraction cords (138*a*, 138*b*) will be provided below, following a more detailed description of the cocking hooks (106*a*, 106*b*). While the retraction cords 138*a*, 138*b* are depicted (and generally described) as terminating at second ends which are at the terminus of the leg members 130*a*, 130*b* (near leg caps 135*a*, 135*b*), it will be appreciated that the retraction cords can exit the leg members prior to the leg caps, and thus be anchored to other component parts (such as to front mounting bracket 110). In general, the first ends of the retraction cords 138*a*, 138*b* are secured to the respective cocking connectors 106*a*, 106*b*, while the second ends of the retraction cords are secured to the cocking-cord apparatus 100 at positions which are located more distal from the cocking cord 102 than are the first ends of the retraction cords. For example, the second ends (not numbered) of the retraction cords 138*a*, 138*b* of FIGS. 1 and 2 can exit the respective leg members 130*a*, 130*b* prior to the terminus points of the leg members (i.e., leg caps 135*a*, 135*b*), and can be attached to the front mounting bracket 110, which will thus locate (and secure) the second ends of the retraction cords at positions which are located more distal from the cocking cord 102 than are the first ends of the retraction cords. In general, the terminal (or second) ends of the elasticized retraction cords (138*a*, 138*b*) (i.e., those ends of the retraction cords distal from their first end connections to the cocking connectors 106*a* and 106*b*) are attached to the apparatus 100, or to the crossbow 1, in order to ensure that a tensile force is imposed on the retraction cords in order to draw the cocking-cord connectors (106*a*, 106*b*) into proximity to the sides of the crossbow frame (3, FIG. 12, and as shown in phantom lines in FIGS. 1 and 2).

Figure 11:
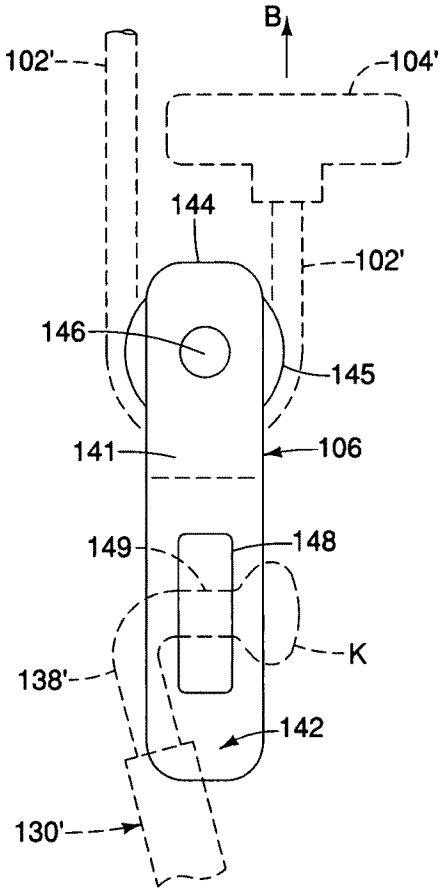
FIG. 11 is a bottom view of the bow-cocking hook depicted in FIG. 9.
Figure 10:
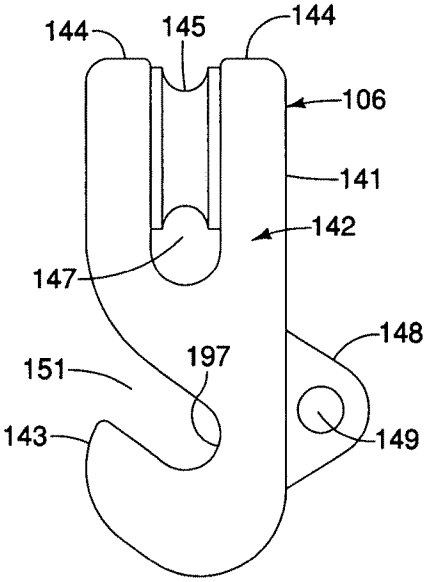
FIG. 10 is a side view of the bow-cocking hook depicted in FIG. 9.
Figure 9:
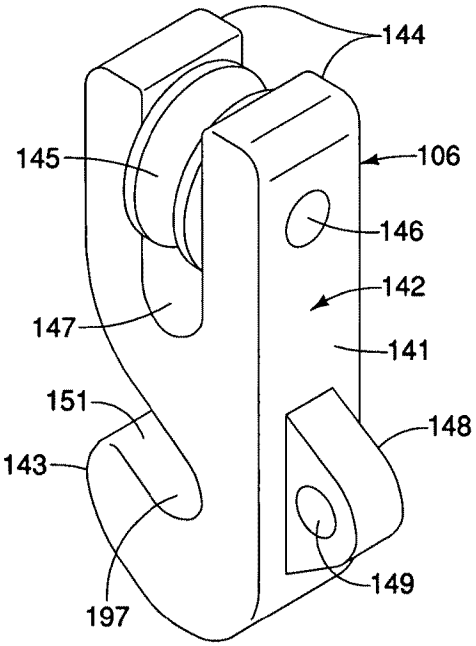
FIG. 9 is an isometric view of a bow-cocking hook that can be used in the bow-cocking apparatus depicted in FIGS. 1-4.

Turning now to FIGS. 9-11, a cocking hook (cocking connector, and/or cocking cord connector) 106 is depicted as follows: (i) FIG. 9 is an isometric view of the cocking hook 106; (ii) FIG. 10 is a side view of the cocking hook 106; and (iii) FIG. 11 is a bottom view of the cocking hook 106. The cocking hook 106 can be used for both of the cocking hooks 106*a*, 106*b* of FIGS. 1, 2 and 13. The cocking hook 106 includes a cocking hook body 142, which further includes a cocking hook member 143. The cocking hook body 142 and the cocking hook member 143 together define a bowstring opening 151, and a bowstring throat 197, which allows a bowstring (8, FIG. 13) to be engaged by the cocking hook 106 within the bowstring throat. The cocking hook body 142 also includes two generally parallel cocking hook arms 144 which together define a cocking cord opening 147. The cocking cord opening 147 is sized to allow a cocking cord (102, FIG. 1) to freely move within the opening 147. A pulley 145 is disposed between the cocking hook arms 144, and is held in place by a spindle (cocking cord connector spindle) 146 which passes through the arms 144. (The spindle 146 can be press-fit into the pulley 145, and can spin in spindle support holes, not numbered, in the cocking hook arms 144.) The pulley 145 closes the cocking cord opening 147 between the arms 144. FIG. 11 depicts a cocking cord 102' (shown in phantom lines), which terminates at one end in a cocking cord handle 104' (also shown in phantom). As can be seen in FIG. 1, since the cocking cord 102 is continuous and terminates at each end thereof with a cocking handle (104*a*, 104*b*), the cocking cord 102' in FIG. 11 is essentially trapped in the cocking cord opening 147 (see FIG. 10) by the cocking cord handle 104'. The cocking hook 106 of FIGS. 9-11 also includes a retraction cord connector 148 which is attached to the bottom 141 of the cocking hook body 142. As depicted in FIGS. 9-11, the retraction cord connector 148 includes a flange member (148) having a retraction cord opening 149 defined there-through. With respect to FIG. 11, a cocking apparatus leg member 130' is partially shown in phantom, with a retraction cord 138' (also in phantom) protruding from an open end of the leg member. (Recall that leg members 138*a*, 138*b* are preferably hollow tubes.) The retraction cord 138' passes through the retraction cord opening 149, and can be secured (or anchored) within the opening 149 by means such as knotting the end of the retraction cord (indicated in FIG. 11 by knot "K", shown in phantom).

Still referring to FIG. 11, as can be seen, as the cocking cord handle 104' is pulled in direction "B" by a user, a force is exerted on the pulley 145 by the cocking cord 102', causing the cocking hook 106 to in turn exert a responsive force on the retraction cord 138' (by virtue of the retraction cord being attached to the cocking hook). This responsive force causes the retraction cord 138' to elongate (recall that the retraction cords 138*a*, 138*b* are elasticized cord members, and that the ends of the retraction cords which are distal from the cocking hooks 106*a*, 106*b* are secured at the terminal ends of the leg members 130*a*, 130*b*). Thus, as the cocking hook 106 is pulled away from the at-rest position (depicted in FIGS. 1-4) by the pulling action on the cocking cord handle 104', the retraction cord 138' exerts a restorative force on the cocking hook. And when the user releases the cocking cord handle 104', the retraction cord 138' returns to its original (non-elongated) position, drawing the cocking hook 106 back to its original at-rest position, while also drawing the cocking cord handle 104' back into the stored position depicted in FIG. 11. As will be described more fully below, when a bowstring is engaged by the bowstring opening 151 in the cocking hook 106, drawing the cocking cord handle 104' (in the manner just described) will cause the cocking hook 106 to exert a force on the bowstring as the cocking hook moves away from its at-rest position. In this way the cocking hook 106 can draw a bowstring when the user pulls on the cocking cord handles (104*a*, 104*b*, and as represented in phantom by 104' in FIG. 11).

While the cocking hook 106 of FIGS. 9-11 is depicted as having a pulley 145, this is not essential, and the cocking cord (102') can ride directly against the spindle 146. However, the inclusion of the pulley 145 reduces wear that would be imparted by the cocking cord 102 riding directly on the spindle 146, and also reduces the effort required to draw the cocking cord against the cocking hook 106.

Figure 16:
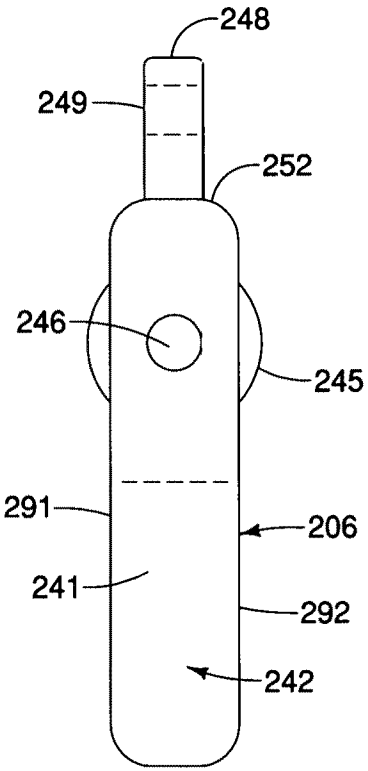
FIG. 16 is a bottom view of the alternate bow-cocking hook depicted in FIG. 14.
Figure 15:
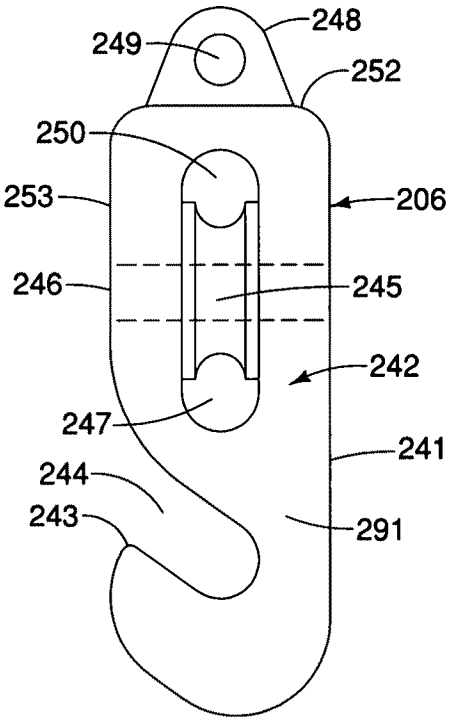
FIG. 15 is a side view of the alternate bow-cocking hook depicted in FIG. 14.
Figure 14:
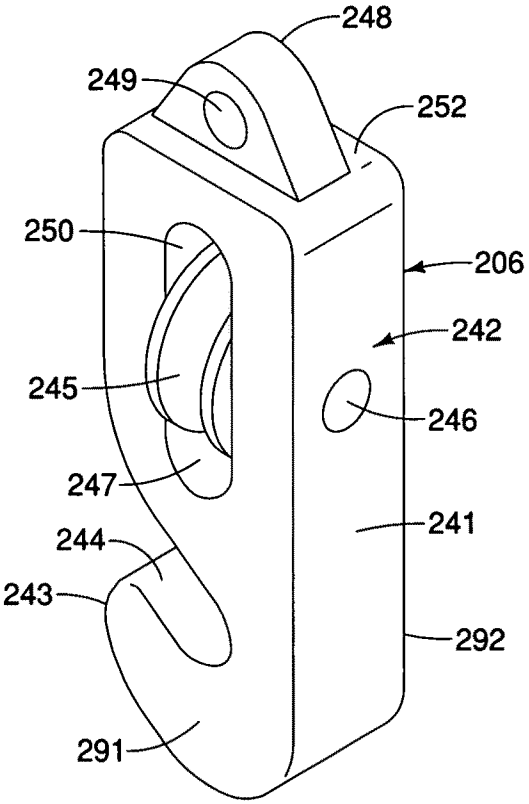
FIG. 14 is an isometric view of an alternate bow-cocking hook that can be used in the bow-cocking apparatus depicted in FIGS. 1-4.

An alternative cocking hook (i.e., alternative to the cocking hook 106 of FIGS. 9-11) is depicted in FIGS. 14-16. The alternative cocking hook 206 of FIGS. 14-16 is depicted as follows: (i) FIG. 14 is an isometric view of the alternative cocking hook 206; (ii) FIG. 15 is a side view of the cocking hook 206; and (iii) FIG. 16 is a bottom view of the cocking hook 206. The cocking hook (cocking connector, and/or cocking cord connector) 206 can be used for both of the cocking hooks 106*a*, 106*b* of FIGS. 1, 2 and 13. The cocking hook 206 includes a cocking hook body 242, which further includes a cocking hook member 243. The cocking hook body 242 and the cocking hook member 243 together define a bowstring opening 244, which allows a bowstring (8, FIG. 13) to be engaged by the cocking hook 206. The cocking hook body 242 defines an elongate slot 250 which passes through the cocking hook body from a first side 291 to a second side 292 of the cocking hook body. Disposed within the elongate slot 250 is a pulley 245, which is held in place within the elongate slot by a spindle 246 (similar to spindle 146 of FIGS. 9-11) which passes through the cocking hook body 242 from the bottom side (241) thereof to the top side (253, FIG. 15) thereof. (The spindle 246 can be press-fit into the pulley 245, and can spin in spindle support holes, not numbered, in the cocking hook body 242.) The positioning of the pulley 245 within the elongate slot 250 of the cocking hook body 242 defines a cocking cord opening 247, which is similar to the cocking cord opening 147 of the cocking hook 106 of FIGS. 9-11. That is, the cocking cord opening 247 allows the cocking cord 102 (FIG. 1) to move freely within the cocking cord opening, and to ride against the pulley 245. The cocking hook 206 further includes a retraction cord connector 248 which is attached to an upper end 252 of the cocking hook body 242 (the upper end 252 of the cocking hook body 242 being generally opposite to the end of the cocking hook body 242 which includes the cocking hook member 243). The retraction cord connector 248 defines there within a retraction cord opening 249.

Figure 17:
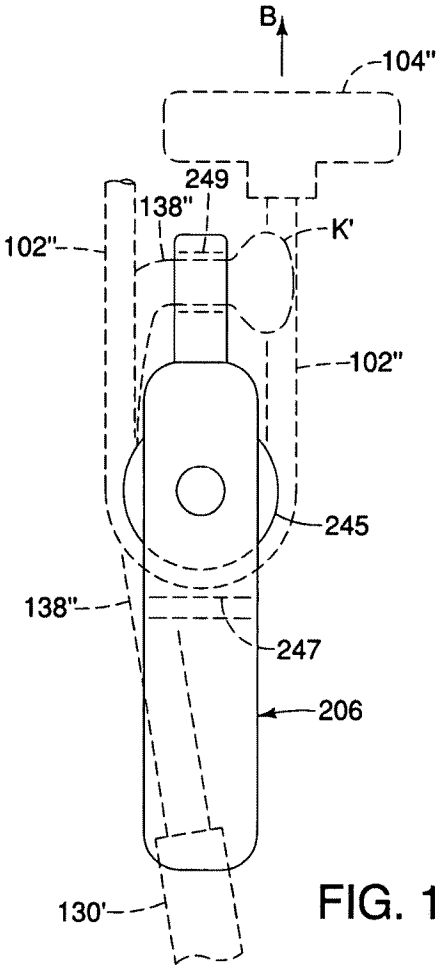
FIG. 17 is a further bottom view of the alternate bow-cocking hook depicted in FIG. 16, and including interactions (depicted by phantom lines) with components of a previous embodiment of the bow-cocking apparatus, as generally depicted in FIG. 11.

FIG. 17 is a bottom view of the cocking hook 206 of FIGS. 14-16 (and generally following the bottom view of FIG. 16), and further depicting (in phantom lines) how the cocking cord (102" of FIG. 17, similar to cocking cord 102' of FIG. 11) and the retraction cord (138", similar to retraction cord 138' of FIG. 11) can be fitted to the cocking hook 206. More specifically: (i) the cocking cord 102" passes through the cocking cord opening 247, around (and under) pulley 245, and terminates at cocking handle 104" (shown only partially in FIG. 17); and (ii) retraction cord 138" issues from the open end of leg member 130', passes through retraction cord opening 249, and is secured to the cocking hook 206 by virtue of knot K' (or by other means which prevent the end of the retraction cord from being pulled through the retraction cord opening 249). Thus, by pulling cocking cord handle 104" in direction "B" (similar to FIG. 11) the cocking cord 102" draws the cocking hook 206 in a similar direction, but as resisted by the elasticized retraction cord 138".

It will be appreciated that the bottom view of cocking hook 106 depicted in FIG. 11 generally corresponds to a detail of the right side portion of the bottom view of the bow-cocking apparatus 100 of FIG. 2. Similarly, the bottom view of cocking hook 206 depicted in FIG. 17 generally corresponds to a modified detail of the right side portion of the bottom view of the bow-cocking apparatus 100 of FIG. 2 (but using the alternative cocking hook 206).

Figure 18:
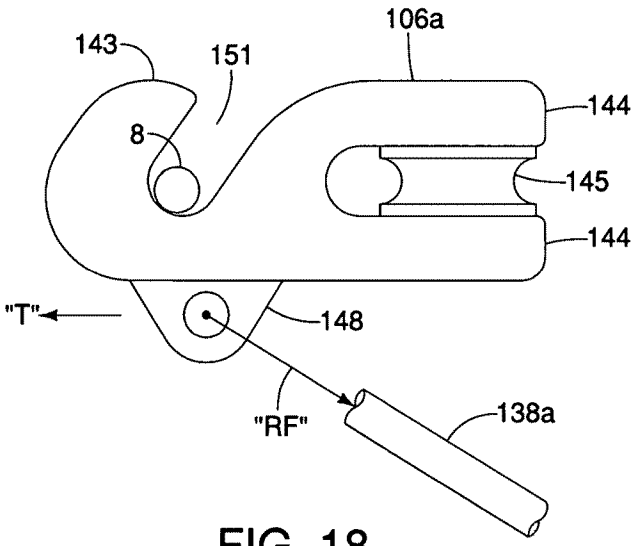
FIG. 18 is a simplified side-view vector diagram of the bow-cocking hook of FIGS. 9-11.

The positioning of the retraction cord connector 148 on the cocking hook 106 (FIGS. 9-11) is selected to ensure engagement of the cocking hook 143 with a bowstring when a bowstring is placed in the bowstring opening 151. In the example depicted in FIGS. 9-11, the retraction cord connector 148 is located on the bottom (141) of the cocking hook 106 closer to the cocking hook 143 than to the cocking cord opening 147. Such positioning of the retraction cord connector 148 on the bottom 141 of the cocking hook body 142 (i.e., closer to the bowstring opening 151 than to the cocking cord opening 147) facilitates in keeping a bowstring engaged in the bowstring opening 151 when using the bow-cocking apparatus 100. This is depicted in FIG. 18, which is a simplified side-view vector diagram of the bow-cocking hook 106 of FIGS. 9-11 (here, depicted as cocking hook 106*a* of FIGS. 1 and 2). In FIG. 18 the cocking hook 106*a* is placed in contact with the bowstring 8, and prior to any cocking forces being exerted on the cocking hook 106*a* by the cocking cord (not shown in FIG. 18). At this point the only forces acting on the cocking hook 106*a* are a retraction force "RF" exerted by the retraction cord 138*a*, and an equal and opposite resisting force (not shown) that is exerted by the bowstring 8. As can be appreciated from FIG. 18, as the retraction cord connector 148 is positioned farther away from the cocking connector arms 144 (i.e., in direction "T"), the retraction force "RF" can cause the cocking hook 106*a* to rotate about the bowstring 8, thus promoting the cocking hook from becoming disengaged from the bowstring. However, the retraction cord connector 148 can be located at other positions on the bottom (141) of the cocking hook 106 depending upon the specific crossbow for which the apparatus is being used.

Figure 19A:
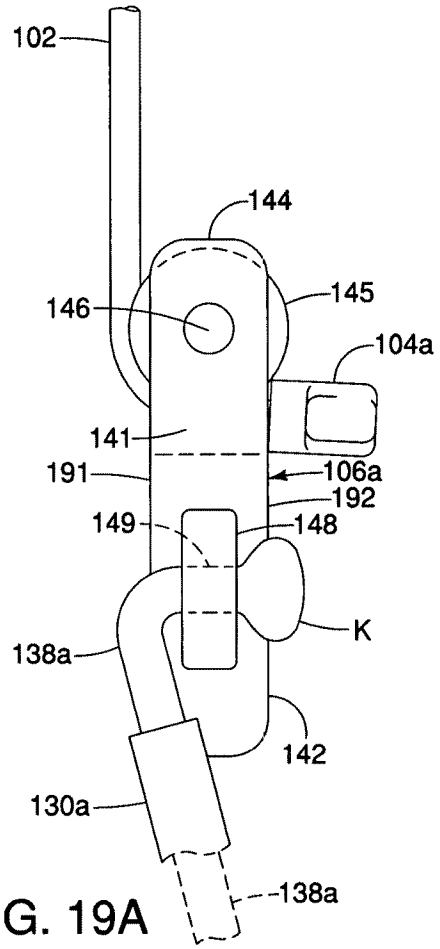
FIG. 19A is a detail drawing of one of the bow-cocking hooks depicted in FIG. 2.
Figure 19:
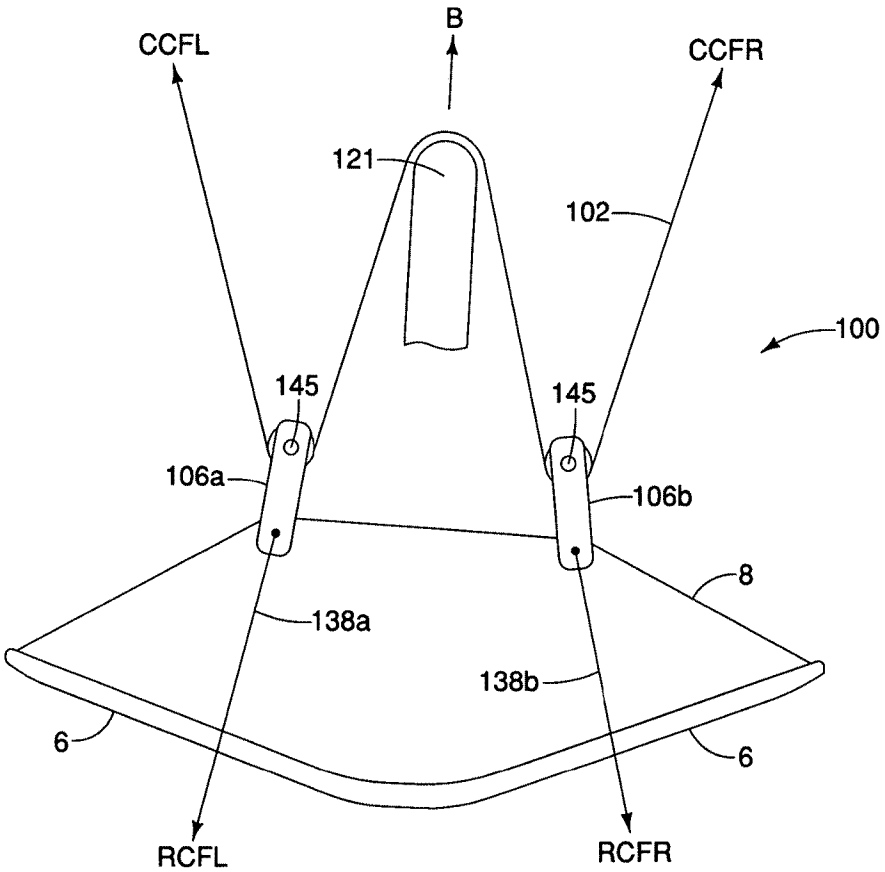
FIG. 19 is a plan view vector diagram depicting how forces are distributed on the cocking cord, the retraction cord, and the bowstring during use of the bow-cock apparatus of FIGS. 1-3.

FIG. 19 is a plan view vector diagram depicting how forces are distributed on the cocking cord (102), the retraction cords (138*a*, 138*b*), and the bowstring (8) during use of the cocking-cord apparatus 100 of FIGS. 1-3. Specifically, in FIG. 19 the crossbow cocking apparatus 100 is depicted as having the bow-cocking hooks (106*a*, 106*b*) engaged with a bowstring 8 (FIG. 12). In FIG. 19 a user imparts cocking cord forces (left cocking cord force "CCFL", and right cocking cord force "CCFR") to the cocking cord 102 by pulling on respecting cocking cord handles 104*a*, 104*b* (FIG. 1, not shown in FIG. 19) in the general direction "B" of FIG. 11. These cocking cord forces ("CCFL" and "CCFR") thus impart forces to the cocking cord hooks (106*a*, 106*b*) via pulleys 145 (one pulley for each cocking cord hook). The forces imparted on the cocking cord hooks (106*a*, 106*b*) are resisted primarily by the resistive cocking force of the bowstring (8), as well as by the elasticized retraction cords (138*a*, 138*b*) which are attached to the cocking cord hooks. So long as the user exerts a greater force ("CCFL" and "CCFR") on the cocking cord 102 than is resisted by the bowstring 8 (and the retraction cords 138*a*, 138*b*), the cocking cord will tend to draw the bowstring back into a cocked position. Once the bowstring (8) is engaged by the crossbow latch (9, FIG. 12), the user can release the tension being applied to the cocking cord (102), and the retraction cords (138*a*, 138*b*), will return the cocking cord to the stored position (as depicted in FIGS. 1-3).

FIG. 19A is detail bottom view of the cocking connector 106*a* (also described herein as a cocking hook) depicted in FIG. 2, using the cocking cord connector 106 depicted in FIGS. 9-11. The cocking cord connector 106*a* is defined by a first side 191 which faces inward towards the crossbow frame 3 (see FIG. 2), and a second side 192 which faces outward, away from the crossbow frame. In the example depicted in FIG. 19A the retraction cord 138*a* exits the open end (not numbered) of the leg member 130*a* proximate the first (inward facing) side 191 of the cocking cord connector 106*a*. In this example the retraction cord 138*a* is preferably anchored to the retraction cord connector 148 proximate the second, outward-facing side 192 of the cocking connector 106*a*. (In the example shown in FIG. 19A, the retraction cord 138*a* is anchored to the retraction cord connector 148 by a knot "K".) Also preferably, the retraction cord 138*a* is placed under tension (for example, between about 0.5 pounds force and 1.5 pounds force) when the cocking hook 106*a* is placed in the stored position depicted in FIGS. 2, 13 and 19A. This arrangement (i.e., placing the retraction cord 138*a* under tension when the cocking cord connector 106*a* is in the stored position) results in the retraction cord 138*a* tending to pull the cocking cord connector 106*a*, as well as the cocking cord handle 104*a* (depicted in end view), inwards towards the frame (3) of the crossbow (see FIGS. 2 and 13). A similar situation can be present with respect to the cocking cord connector 106*b*, the retraction cord 138*b*, and the cocking cord handle 104*b*, by virtue of the symmetry of these elements with their respective counterparts, as depicted in FIGS. 1 and 2. The arrangement depicted in FIG. 19A thus results in the cocking cord connectors (e.g., 106*a*) and the cocking cord handles (e.g., 104*a*, shown in end view in FIG. 19A) being placed in a convenient stored position during non-use (as per FIGS. 1 and 2) such that they do not interfere with other operations of the crossbow.

Figure 20:
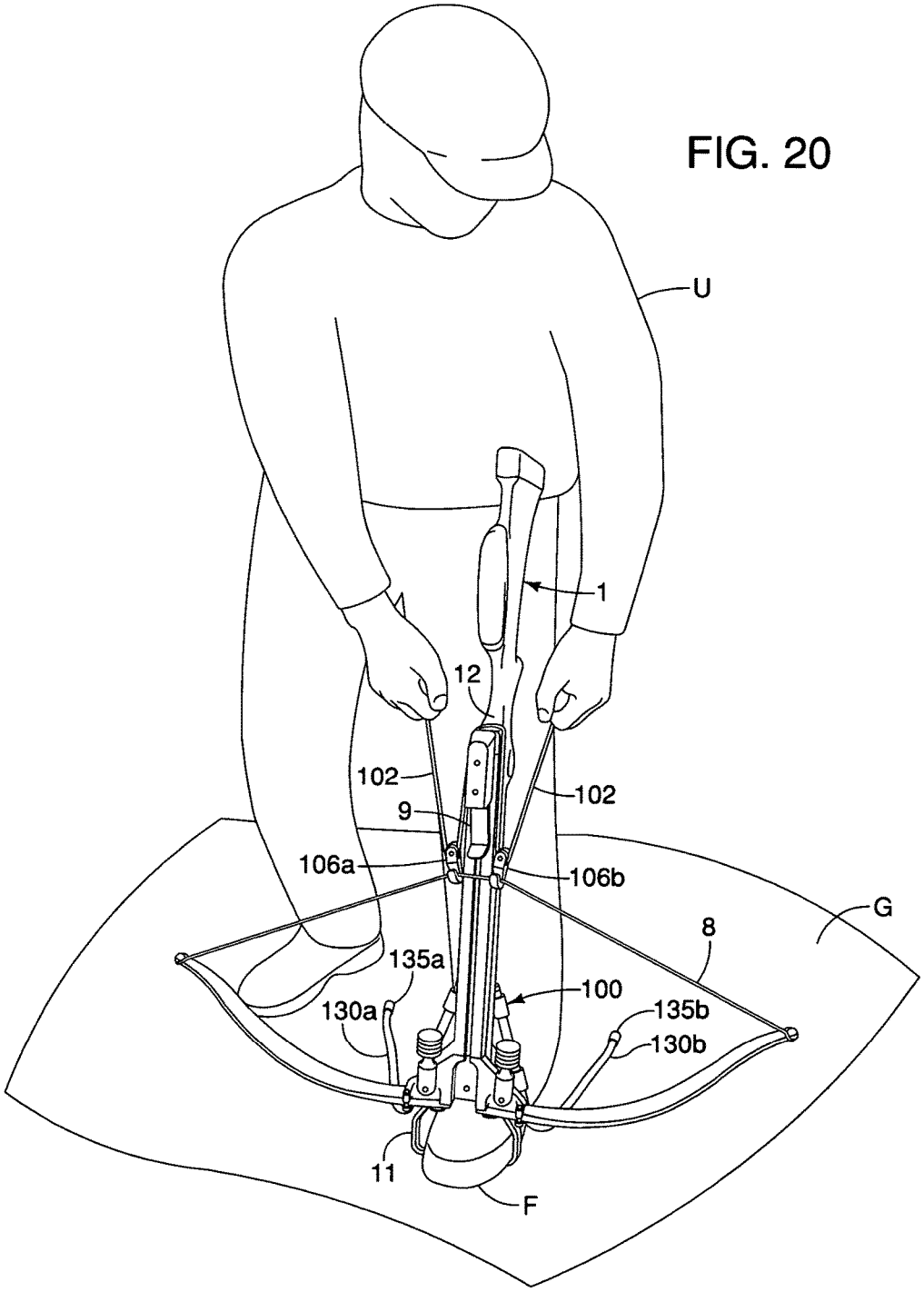
FIG. 20 is an environmental view depicting a user cocking the bowstring of a crossbow using the cocking-cord apparatus of FIGS. 1-3.

FIG. 20 is an environmental view depicting a user ("U") cocking the bowstring (8) of a crossbow (1) using the bow-cocking apparatus (100) of FIGS. 1-3. (See FIG. 12 for reference to the components of the crossbow 1.) In FIG. 20 the user "U" has positioned the leg members 130*a*, 130*b* of the bow-cocking apparatus 100 so that the feet (135*a*, 135*b*) of the respective leg members are in contact with a ground surface "G", and the cocking stirrup 11 of the crossbow 1 is further in contact with the ground surface. Preferably the crossbow 1 is positioned (with respect to the user "U") such that the shoulder 12 of the crossbow is closer to the user than is the cocking stirrup 11—i.e., the crossbow angles inward towards the user from the cocking stirrup 11 to the crossbow shoulder 12. The user "U" places a foot ("F") within the cocking stirrup 11, and thus holds the cocking stirrup (and the crossbow 1) in firm contact with the ground surface "G". As depicted in FIG. 20, the cocking cord connectors (106*a*, 106*b*) have been engaged with the bowstring 8, and the user ("U") is grasping the cocking cord handles (not visible in FIG. 20, but correspond to cocking cord handles 104*a* and 104*b* of FIGS. 1-3 and FIG. 13), and the user is pulling the cocking cord handles in direction "B" (see FIGS. 11 and 19). By continually pulling on the cocking cord handles (104*a*, 104*b*, FIG. 1) the cocking cord connectors (106*a*, 106*b*) will eventually pull the bowstring (8) into the latch (9), where the bowstring will become engaged, and the crossbow (and specifically, the bowstring) will thus be placed in a cocked position. Once the bowstring 8 of the crossbow 1 has been placed in the cocked position within the latch 9 of the crossbow, the user "U" can release the cocking handles (104*a*, 104*b*, FIG. 1), and the retraction cords (138*a*, 138*b*, FIGS. 1, 2 and 19) will cause the cocking handles, and the cocking cord connectors (106*a*, 106*b*) to be returned to the stored position (as depicted in FIGS. 1-3 and 13).

FIGS. 21-28 collectively depict a sequence series of plan and side view drawings of a crossbow 1 using the crossbow cocking apparatus 100 of the present disclosure to cock the crossbow. Specifically, FIGS. 21, 23, 25 and 27 are sequential side view drawings, and FIGS. 22, 24, 26 and 28 are the respective corresponding plan view drawings. With respect to FIGS. 21 and 22, the crossbow cocking apparatus 100 is mounted to the underside of the crossbow 1 (FIG. 21), and is in stored or non-deployed position. The leg members (or legs) 130*a*, 130*b* can be positioned as depicted in FIG. 20 to allow the crossbow 1 to be supported on a ground surface during the cocking operation. The cocking handles 104*a*, 104*b*, and the cocking cord connectors 106*a*, 106*b*, are tucked in at the side of the crossbow frame 3, and are held in those positions by virtue of the retraction cords (not visible in FIGS. 21 and 22, but corresponding to 138*a* and 138*b* of FIGS. 2 and 1, respectively). Also, the cocking cord 102 is held closely to the crossbow frame 3 by the cocking cord connectors 106*a*, 106*b*, and the bowstring 8 is resting against the bowstring shock absorbers (not numbered). (Bowstring shock absorbers are a commonly used accessory device, but are not present on all crossbows.)

Figure 23:
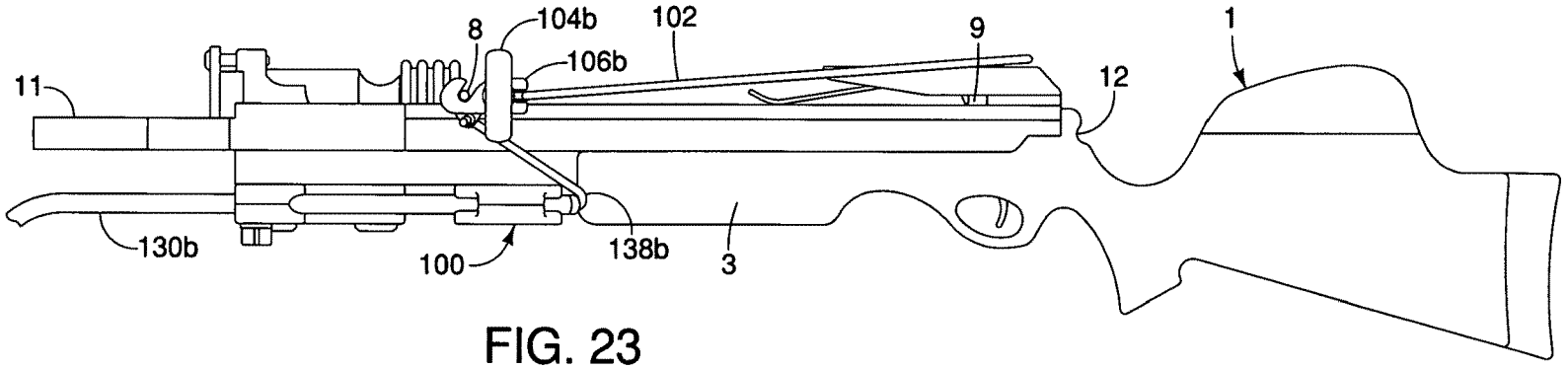
FIG. 23 is a side view of the crossbow and bow-cocking apparatus of FIG. 21, but with the cocking cord connectors fitted to the bowstring for cocking of the crossbow.
Figure 24:
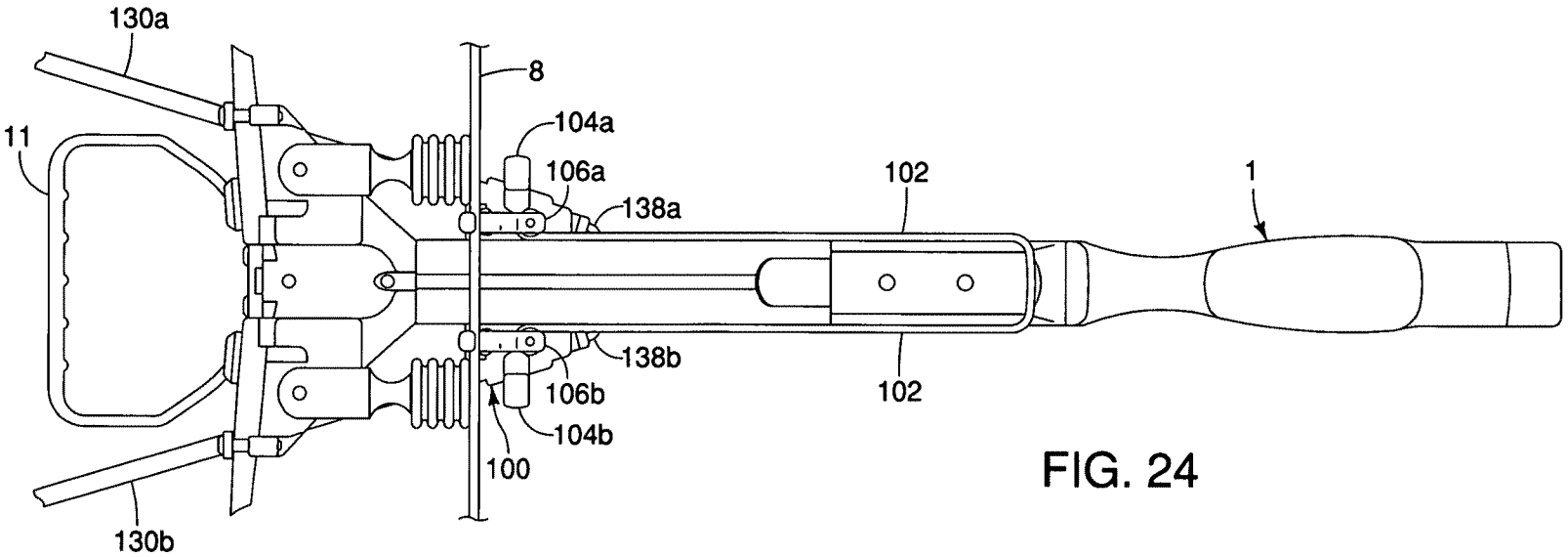
FIG. 24 is a plan view of the crossbow and bow-cocking apparatus of FIG. 23.

The next step is to engage the cocking hooks (cocking cord connectors 106*a*, 106*b*) with the bowstring 8. One manner for doing this is depicted in FIGS. 23 and 24. Turning now to FIGS. 23 and 24, the cocking cord connectors 106*a*, 106*b* have been moved from the stored positions of FIG. 21, and are placed in engagement with the bowstring 8. As can be seen in FIG. 23, the elasticized retraction cord 138*b* has been stretched to allow the cocking connector 106*b* to be placed in engagement with the bowstring 8. Also, the cocking handles 104*a*, 104*b* have moved from the stored positions of FIGS. 21 and 22 to a slightly elevated (and forward) position proximate the bowstring 8, which facilitates the user in grasping the cocking handles. In order to allow the cocking handles 104*a*, 104*b* to move forward towards the bowstring 8, the cocking cord 102 is released from the shoulder 12 of the crossbow 1, as depicted in FIG. 23. Once the cocking connectors 106*a*, 106*b* are engaged with the bowstring, the user can pull back on the cocking cord and place it around the shoulder 12 of the crossbow 1 (as depicted in FIG. 24).

Figure 21:
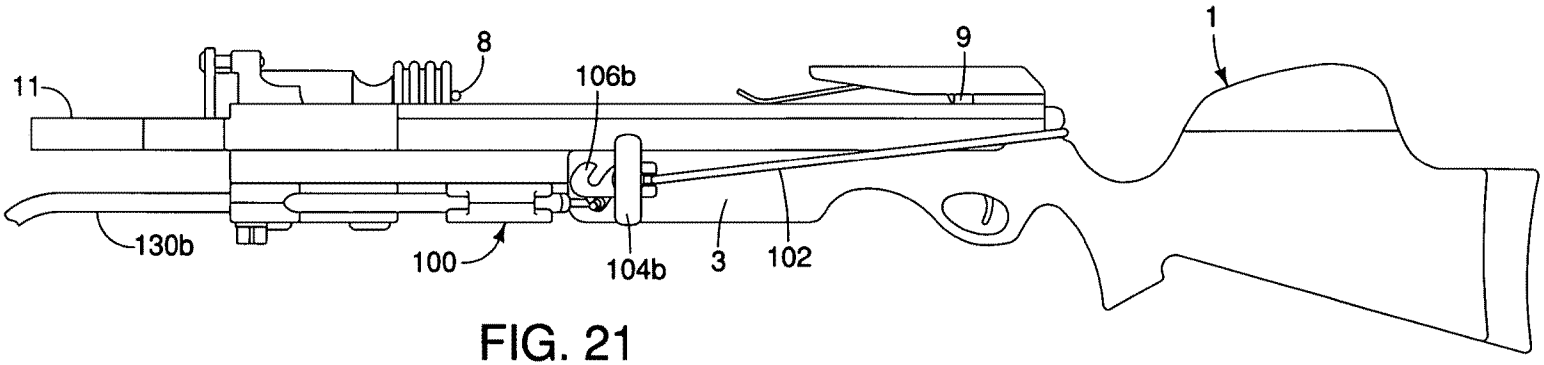
FIG. 21 is a side view of the crossbow and bow-cocking apparatus of FIG. 13, depicting the crossbow in an uncocked position and the components of the bow-cocking apparatus in a stored position.
Figure 22:
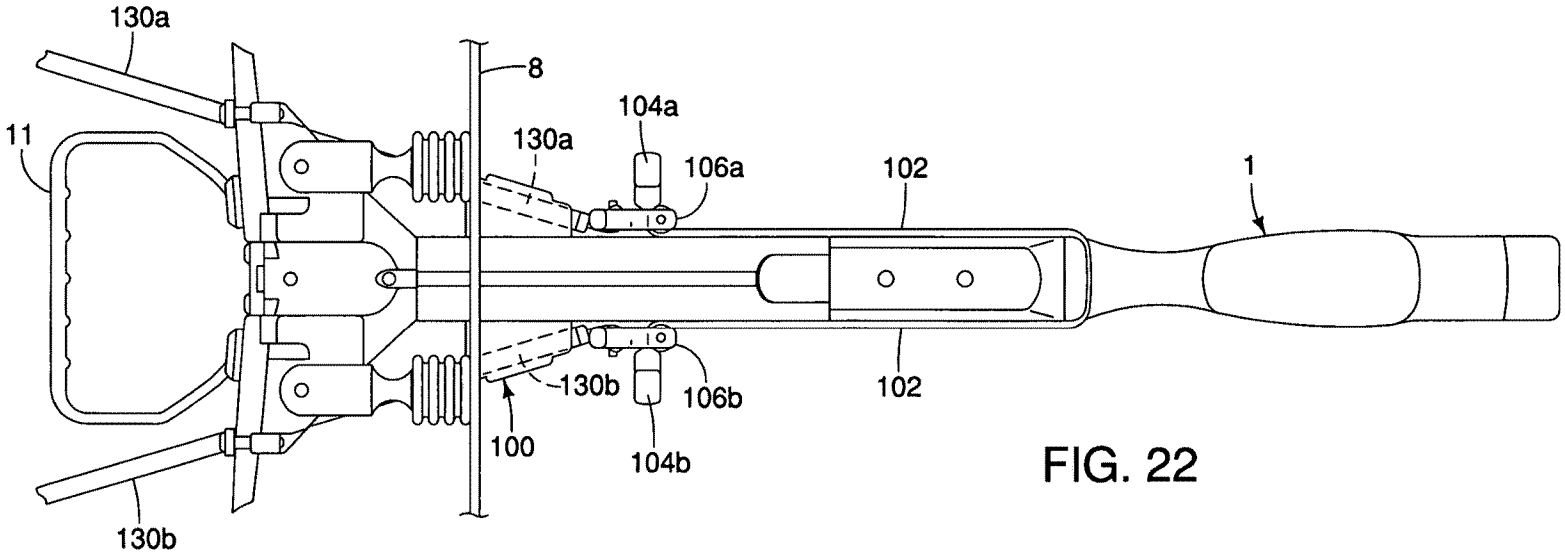
FIG. 22 is a plan view of the crossbow and bow-cocking apparatus of FIG. 21.

It will be appreciated that, in addition to the manner described in the above paragraph, other manners for engaging the cocking hooks (cocking cord connectors 106*a*, 106*b*) with the bowstring 8 can also be employed. In a first variation a first cocking cord connector (e.g., 106*a*) can be manually moved forward (i.e., towards the bowstring 8), and engaged with the bowstring 8, without releasing the cocking cord 102 from the shoulder 12 of the crossbow 1. In this example the cocking cord connector (e.g., 106*a*) which is manually engaged with the bowstring 8 causes the cocking cord 102 to rotate about the shoulder 12 (counter-clockwise rotation, as per FIG. 22), thus causing the second cocking cord connector (e.g., 106*b*) to be moved rearward (i.e., towards the shoulder 12), and thus imparting a slight tensile force within the second retraction cord (e.g., 138*b*, FIGS. 1 and 4). The second cocking cord connector (e.g., 106*b*) can then be manually moved forward (i.e., towards bowstring 8), and engaged with the bowstring. In a second variation, the user can manually draw the bowstring 8 back to a position where one, or both, of the cocking cord connectors 106*a*, 106*b* can then be moved from the stored position into a position to engage the bowstring. It will be further appreciated that the manual force required to move a cocking cord connector (e.g., 106*a*) forward towards the bowstring 108 (per the first variation described above), or to move the bowstring 8 rearward towards a cocking cord connector (per the second variation described above) is minimal (perhaps amounting to around 10 pounds of force), and can easily be applied by the user. The force required to manually engage the cocking connectors (106*a*, 106*b*) with the bowstring 8 (or, alternately, to engage the bowstring 8 with the cocking connectors (106*a*, 106*b*), is thus minimal as compared to the force ultimately required to draw the bowstring 8 back to a position whereby it can be engaged by the bowstring latch 9 (FIGS. 12 and 21). This later draw force (required to engage the bowstring 8 with the latch 9, as described below) is imposed by the user pulling on the cocking handles (104*a*, 104*b*) once the cocking cord connectors 106*a*, 106*b* have been engaged with the bowstring 8.

Once the cocking connectors (106*a*, 106*b*) have been engaged with the bowstring 8 (in any of the manners described above), the user can pull on the cocking cord handles (104*a*, 104*b*) to draw the bowstring 8 back into a position towards the bowstring latch 9 (FIG. 21), as per FIGS. 25 and 26, described immediately below.

Figure 25:
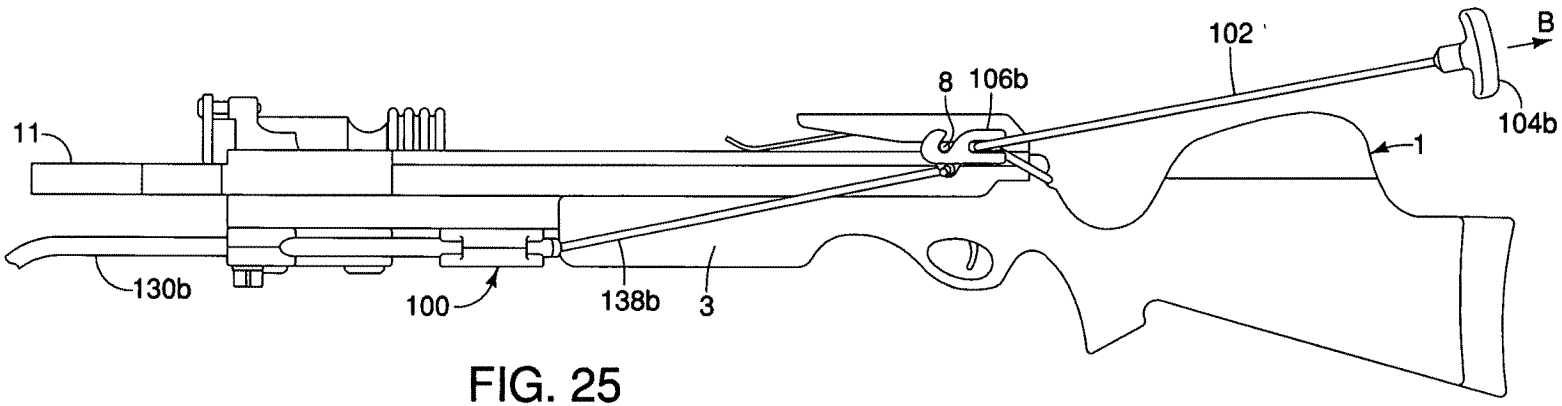
FIG. 25 is a side view of the crossbow and bow-cocking apparatus of FIG. 23, but with the cocking cord connectors depicted as pulling the bowstring into the crossbow latch.
Figure 26:
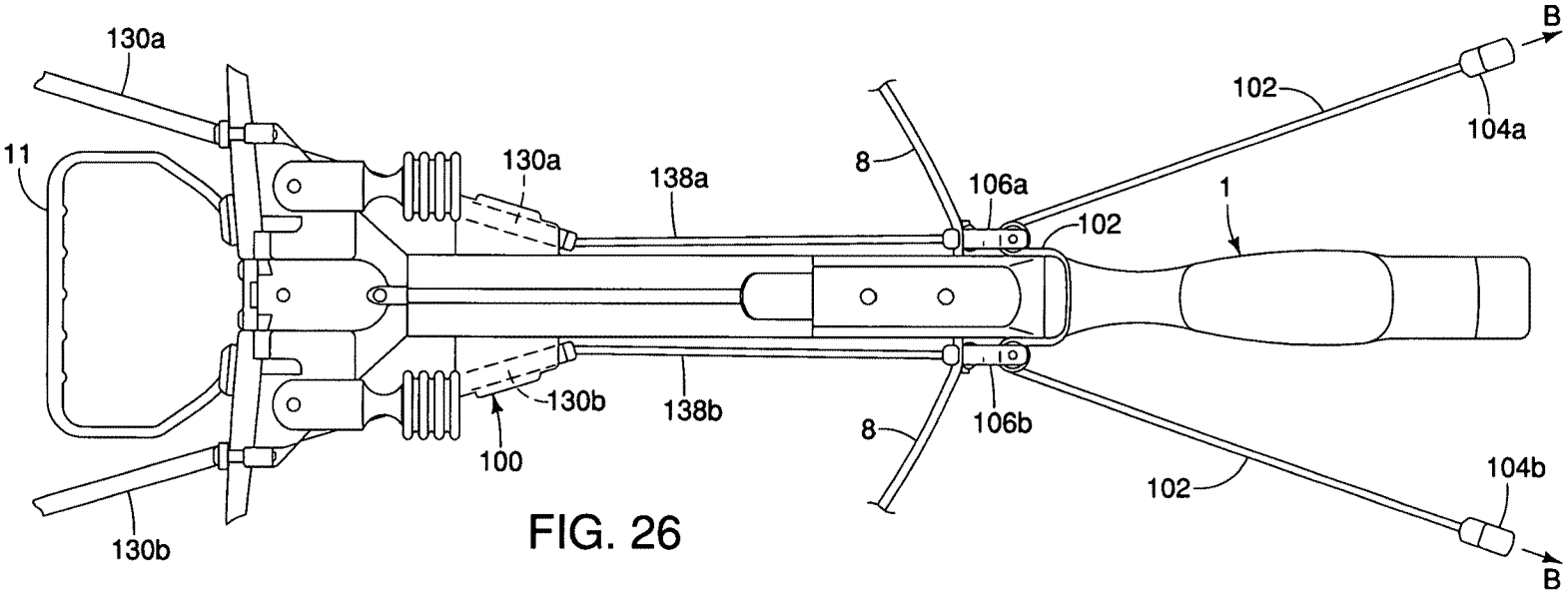
FIG. 26 is a plan view of the crossbow and bow-cocking apparatus of FIG. 25.

As depicted in FIGS. 25 and 26, a user can pull on the cocking cord handles 104*a*, 104*b* in directions "B" in order to draw the bowstring 8 rearward towards, and into engagement with, the bowstring latch 9 (see also FIG. 20). (Directions "B" are directed generally rearward—i.e., away from the cocking stirrup 11. See also FIGS. 11 and 19.)). When drawing the cocking cord handles 104*a*, 104*b* in the generally rearward directions "B", the cocking cord connectors 106*a*, 106*b* are also thus drawn rearward (i.e., generally toward direction "B") by way of being engaged by the cocking cord 102 (see FIGS. 11 and 19), which in turn draws the bowstring 8 into the latch (9, FIG. 12) of the crossbow 1. As can be seen in FIGS. 25 and 26, the elongate spring members (in this example, elasticized retraction cords 138*a*, 138*b*) are extended (stretched) to allow the cocking cord connectors 106*a*, 106*b* to draw the bowstring 8 into the cocked (or latched) position with latch 9. At this point the crossbow 1 is effectively cocked.

Figure 27:
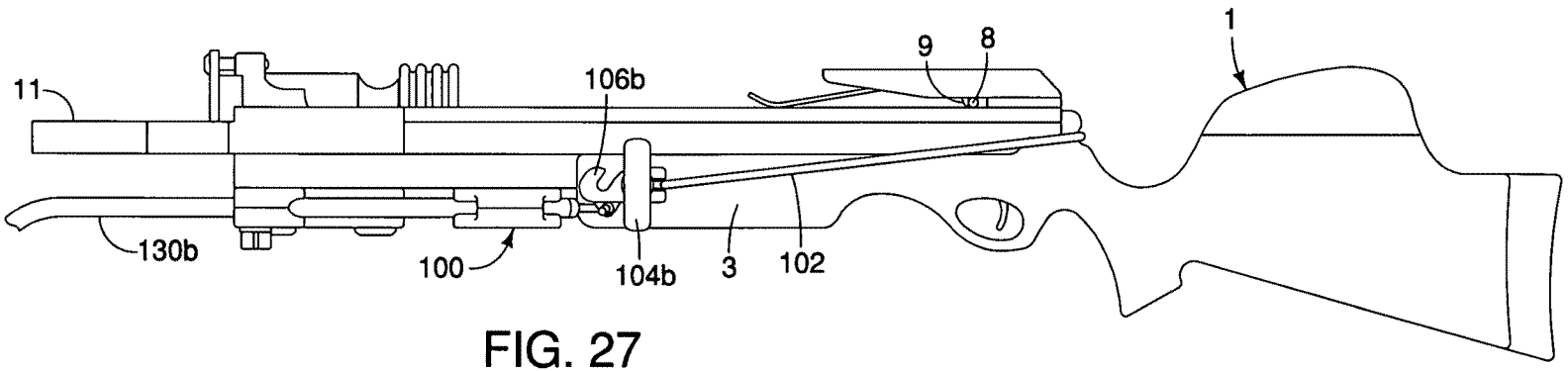
FIG. 27 is a side view of the crossbow and bow-cocking apparatus of FIG. 25, but with the cocking cord connectors removed from the cocked bowstring and in the stored position depicted in FIG. 21.
Figure 28:
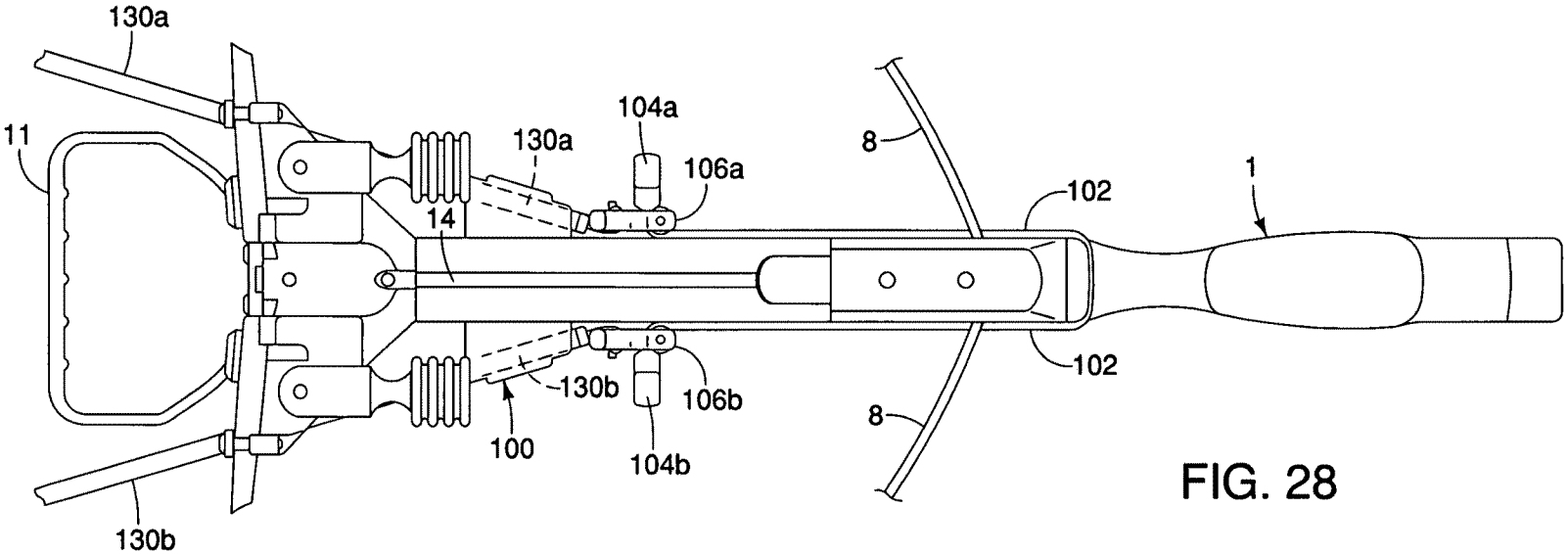
FIG. 28 is a plan view of the crossbow and bow-cocking apparatus of FIG. 27.

Turning now to FIGS. 27 and 28, the bowstring 8 is held in the cocked position by the latch 9 (which can be seen in FIG. 27). Once the bowstring 8 is held in the latched (or "cocked") position, there are no tensile forces imposed on the cocking cord 102, and the only force acting on the cocking cord connectors (106*a*, 106*b*) are the retraction forces exerted by the retraction cords 138*a*, 138*b* (see FIG. 26)). A user can then release the cocking cord connectors 106*a*, 106*b* from the bowstring 8 by merely letting go of (or slowly releasing) the cocking handles 104*a*, 104*b*. Once the cocking handles 104*a*, 104*b* are released, the retraction cords 138*a*, 138*b* (not visible in FIGS. 27 and 28, but see FIGS. 25 and 26) will draw the cocking cord connectors (106*a*, 106*b*), the cocking handles (104*a*, 104*b*), and the cocking cord (102) back to the stored positions depicted in FIGS. 27 and 28. It will be noted that the only difference between FIG. 21 (side view depicting the crossbow 1 in the uncocked position, with the cocking apparatus 100 in the stored position), and FIG. 27 (side view depicting the crossbow 1 in the cocked position, with the cocking apparatus 100 in the stored position) is that in FIG. 21 the bowstring 8 is in the released position, whereas in FIG. 27 the bowstring 8 is secured by the latch 9 in the cocked position. In particular, it will be observed that the cocking cord handles 104*a*, 104*b*, and the cocking connectors 106*a*, 106*b*, are in the stored positions when the crossbow is in both the uncocked condition (FIG. 22—and not in the process of being cocked) and in the cocked position (FIG. 28). Thus, when the crossbow 1 is in the cocked position (FIG. 28), the cocking cord handles 104*a*, 104*b*, and the cocking connectors 106*a*, 106*b* are conveniently stored on-board the crossbow, are out of the way from the flight groove 14 (FIG. 28) which can support a bolt to be fired), and are out of the way of free travel of the bowstring 8 from the cocked position of FIG. 28 to the fired position (corresponding to FIG. 22).

Turning now to FIG. 29, an alternative arrangement of a crossbow cocking apparatus 200 in accordance with the current disclosure is shown in plan view. FIG. 29 is similar to FIG. 1 of the embodiment of the bow-cocking apparatus 100 of FIG. 1, except as provided for in the following discussion. The bow-cocking apparatus 200 of FIG. 29 can include the cocking cord 102, the cocking-cord handles 104*a*, 104*b*, and the cocking cord connectors (also previously described as cocking hooks or cocking connectors) 106*a*, 106*b* of the apparatus 100, as well as variations thereof described above. The bow-cocking apparatus 200 includes a front mounting bracket 210, and a rear mounting bracket 220. The mounting brackets 210, 220 act in a similar manner as respective mounting brackets 110, 120 of the apparatus 100, in order to allow the apparatus 200 to be mounted to a crossbow (such as crossbow 1 of FIG. 12). (It will be appreciated that a single mounting bracket can be used in place of the two mounting brackets 210, 220, as described above with respect to the apparatus 100.) The bow-cocking apparatus 200 of FIG. 29 includes a retraction cord housing 290, which houses a retraction cord 238. The retraction cord housing 290 is preferably a hollow tube member bent into an elongated generally "U" shaped member. It will be appreciated that the retraction cord housing 290 of the apparatus 200 can replace the separate leg members 230*a* and 230*b* of the apparatus 100. The retraction cord housing 290 can be secured to the front mounting bracket 210 by retraction cord housing brackets 212*a* and 212*b*, and to the rear mounting bracket 220 by retraction cord housing brackets 222*a* and 222*b*. A sectional view (FIG. 30) of the retraction cord housing 290 shows how the retraction cord 238 can be contained within the hollow-tube retraction cord housing. The retraction cord housing 290 includes open ends (not numbered) from which terminal ends of the retraction cord 238 issue, and these terminal ends (not numbered) of the retraction cord can then be secured to the cocking connectors 106*a*, 106*b*. The bow-cocking apparatus 200 can thus be provided with a single retraction cord 238, versus the two separate retraction cords 138*a*, 138*b* of the bow-cocking apparatus 100. The retraction cord housing 290 of the bow-cocking apparatus 200 can include a generally transverse bottom member 295 which is oriented generally transverse to (i.e., orthogonal to) the frame 3 (FIG. 12) of the crossbow 1. The transverse bottom member 295 of the retraction cord housing 290 of the bow-cocking apparatus 200 can act as a replacement for, or as a supplement to, the cocking stirrup (11, FIG. 12) of a crossbow to which the cocking apparatus 200 is attached, or the transverse bottom member 295 can be independent (i.e., located away from) the cocking stirrup.

Figure 31:
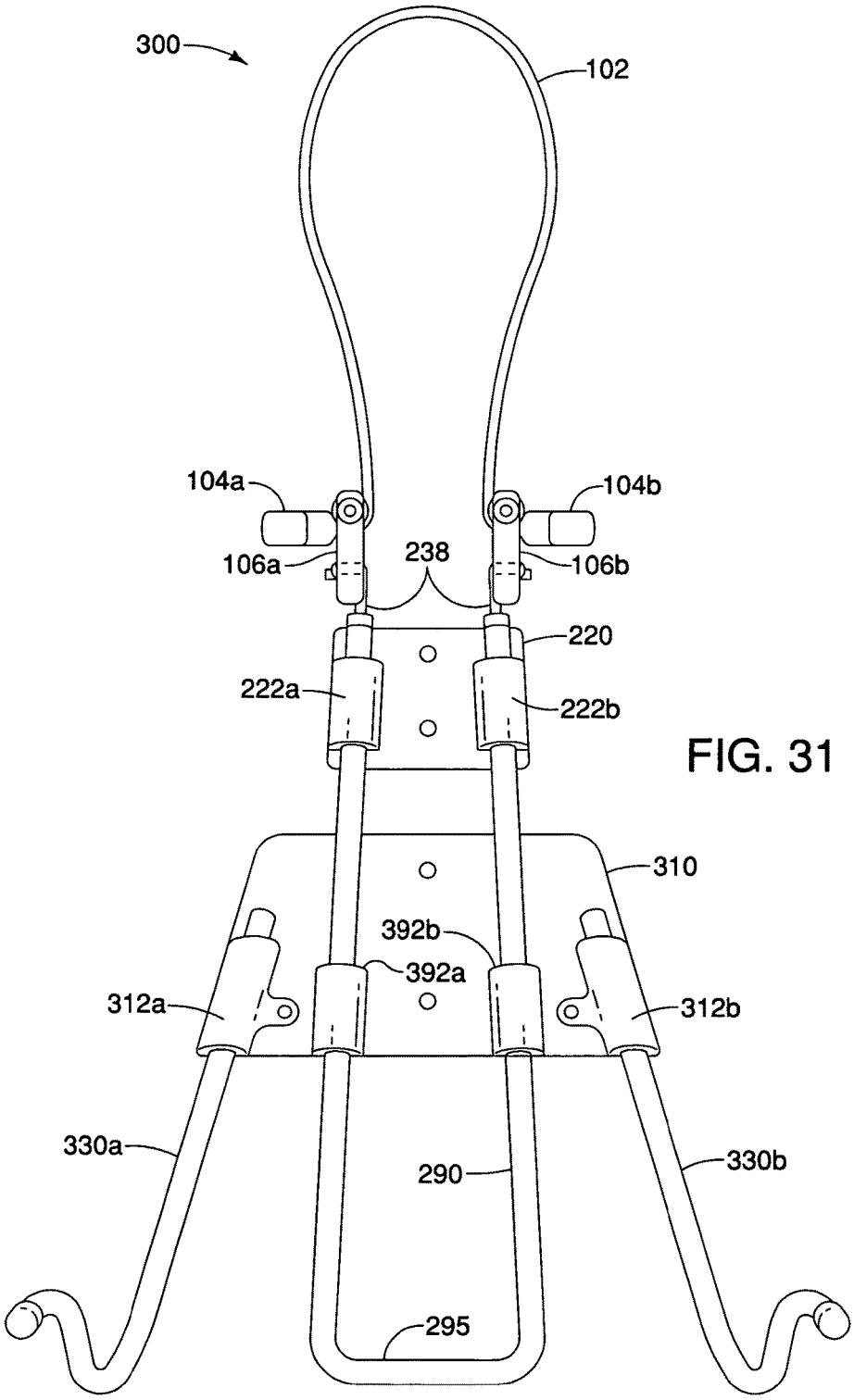
FIG. 31 is a plan view of yet another bow-cocking apparatus according to the present disclosure.

FIG. 31 is a plan view of a further alternative bow-cocking apparatus 300 according to the present disclosure. The crossbow-cocking apparatus 300 of FIG. 31 is essentially a combination of the bow-cocking apparatus 100 of FIGS. 1-3 (et seq.), and the bow-cocking apparatus 200 of FIG. 29. The bow-cocking apparatus 300 of FIG. 31 can include the cocking cord 102, the cocking-cord handles (104*a*, 104*b*), and the cocking-cord connectors (106*a*, 106*b*)

of the cocking-cord apparatuses 100 and 200 (and variations thereon, as presented above), as well as the rear mounting bracket 220, and the retraction cord housing 290 (and retraction cord 238) of the apparatus 200 of FIG. 29. However, the cocking cord apparatus 300 (FIG. 31) differs from the cocking cord apparatuses 100 and 200 (described above) by having a front mounting bracket 310 which not only supports the retraction cord housing 290 (via retraction cord housing support brackets 392*a* and 392*b*), but also supports leg members 330*a* and 330*b* via respective leg member support brackets 312*a* and 312*b*. Leg member support brackets 312*a* and 312*b* can be configured similar to front leg hinge members 112*a* and 112*b* of the apparatus 100, to thus allow the leg members 330*a*, 330*b* of the apparatus 300 to articulate (i.e., be rotated) about the front mounting bracket 310. It will be appreciated that mounting brackets 310 and 320 of the apparatus 300 can be consolidated into a single mounting bracket.

Figure 32:
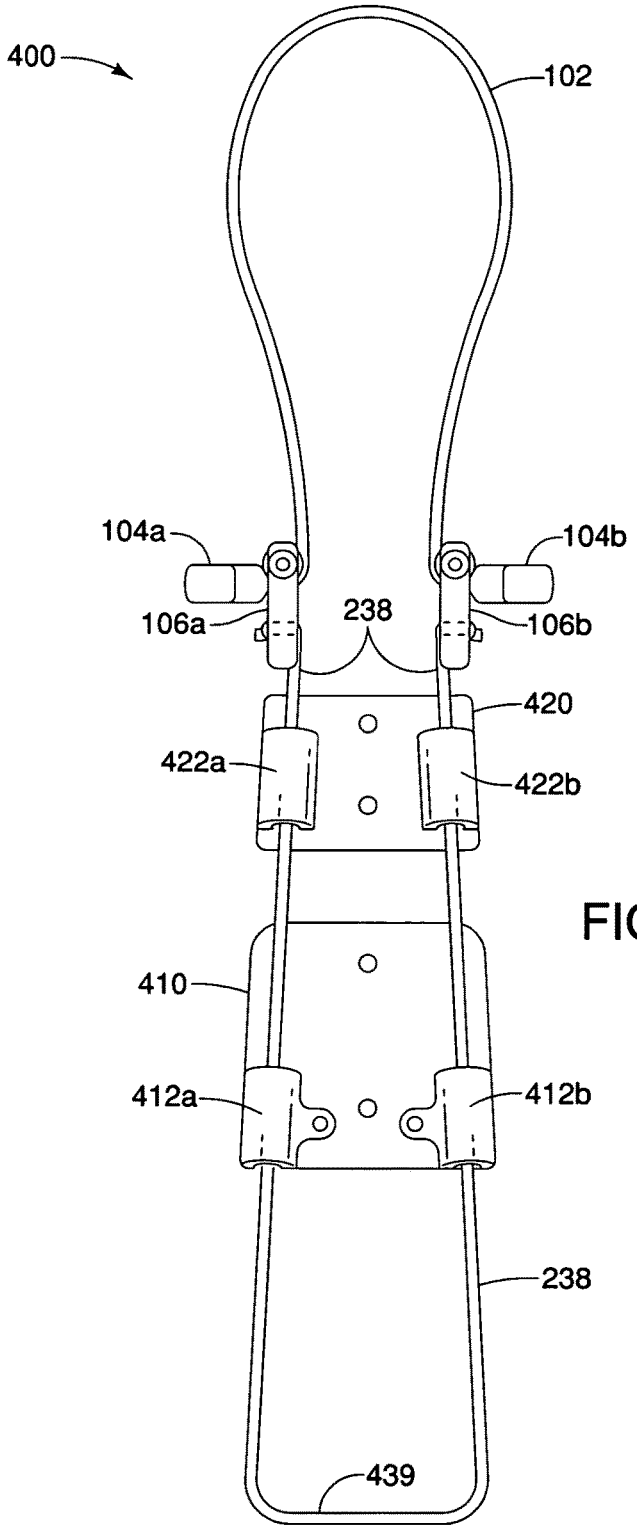
FIG. 32 is a plan view of a further bow-cocking apparatus according to the present disclosure.

While the embodiments of the bow-cocking apparatus described thus far all indicate that the elasticized retraction cord (or cords) are at least partially disposed with a hollow tube segment (e.g., leg members 130*a*, 130*b*, or stirrup-like tube 290 of FIG. 31), it will be understood that this is not a requirement, and that in one embodiment the retraction cord is not disposed with a hollow tube segment. Such an embodiment is depicted in plan view in FIG. 32, showing a bow-cocking apparatus 400 similar to the bow-cocking apparatus 200 of FIG. 29. The bow cocking apparatus 400 (FIG. 32) does not include the retraction cord housing 290 of the apparatus 200 (FIG. 29), and thus the retraction cord 238 of the apparatus 400 is generally exposed, except as provided for below. The retraction cord 238 of the apparatus 400 (FIG. 32) can be the same as the retraction cord 238 of the apparatus 200 (FIG. 29)—the only difference being that in the apparatus 400 the retraction cord 238 is not disposed within the housing 290 (as in the apparatus 200). The bow-cocking apparatus 400 of FIG. 32 can include the cocking cord 102, the cocking-cord handles 104*a*, 104*b*, and the cocking cord connectors (also previously described as cocking hooks, or cocking connectors) 106*a*, 106*b* of the apparatus 100 (and 200), as well as variations thereof described above. The bow-cocking apparatus 400 (FIG. 32) includes a front mounting bracket 410, and a rear mounting bracket 420. The mounting brackets 410, 420 act in a similar manner as respective mounting brackets 210, 220 of the apparatus 200, in order to allow the apparatus 400 to be mounted to a crossbow (such as crossbow 1 of FIG. 12). The front mounting bracket 410 includes retraction cord retaining clips 412*a*, 412*b* which allow the retraction cord 238 to move freely there-through (via openings formed by the clips), but hold the retraction cord in place with respect to the front bracket 410. Similarly, the rear mounting bracket 420 includes retraction cord retaining clips 422*a*, 422*b* which allow the retraction cord 238 to move freely there-through, but hold the retraction cord in place with respect to the rear bracket 420. (As indicated above with respect to other embodiments, front and rear mounting brackets 410 and 420 can be replaced with a single mounting bracket.) The retraction cord 238 (FIG. 32) forms a loop 439 which can be supported by a crossbow by means such as: (i) fitting the retraction cord loop 439 about the front of the crossbow barrel (2, FIG. 12); or (ii) using clips to secure the retraction cord loop 439 to the crossbow stirrup (11 FIG. 12) or to other locations on the crossbow. It will be appreciated that the apparatus 400 of FIG. 32 can also be implemented without the use of mounting brackets 410, 420. Further, the retraction cord housing 290 of the apparatus 300 can be used with the apparatus 400, with or without the mounting brackets 410, 420. When the retraction cord housing 290 is added to the apparatus 400 and no mounting brackets are used, the retraction cord housing can be attached to the crossbow by other mounting means.

As described above, a bow-cocking apparatus according to the present disclosure includes a number of advantages over prior-art bow cocking apparatuses. In the first instance, a bow-cocking apparatus as provided for herein can be stored on-board a crossbow, thus providing ready access to a user, and avoiding the possibility of losing a cocking cord which is a separate unit from the crossbow. A bow-cocking apparatus as provided for herein can also be used with many existing prior-art crossbows. While certain prior art bow-cocking apparatuses can provided on-board storage of a bow-cocking apparatus, such devices are typically incorporated into the overall design of the crossbow, and cannot be retrofitted to other crossbows. Further, a bow-cocking apparatus as provided for herein can be configured such that the cocking handles (e.g., 104*a*, 104*b*) and the cocking-cord connectors (e.g., 106*a*, 106*b*) are stored on-board the crossbow in a position which places them out of the way of interference with the operation of the crossbow once the crossbow is cocked and ready for firing (specifically, the cocking handles and the cocking-cord connectors can be pulled adjacent to the side of the crossbow frame by the tension placed on them by the retraction cords (e.g., 138*a*, 138*b*)).

When a bow-cocking apparatus as provided for herein includes leg members (such as depicted in FIGS. 1-4, 4A and 31), and the leg members are arranged so as to allow rotation thereof (see for example FIG. 4A), then the leg members can be used as a bowstand (e.g., as depicted in FIG. 13), as a bipod stand (e.g., when aiming and firing the bow), and as a bow hanging apparatus (e.g., for hanging the bow from wall-mounted hooks or other convenient locations). (In FIG. 13 a crossbow 1, which includes the bow-cocking apparatus 100, is depicted as resting on a ground surface "G", with the leg members 130*a*, 130*b*, and the stirrup 11, forming a tripod so that the bow 1 is supported in a generally standing position.) With respect to the embodiment depicted in FIGS. 1-4, the allowed individual rotation of each leg member (130*a*, 130*b*) allows the leg members to be separately positioned to accommodate a wide range of circumstances (e.g., when used as a bipod stand on uneven terrain, the leg members can be positioned so as to level the crossbow during firing).

Relative Terminology:

The above disclosure uses relative terminology, such as "about", "generally", and "essentially". Other relative terminology may be used in the above disclosure. The applicant has attempted to provide specific limitations for such relative terminology where essential, but when specific limitations are not provided it will be understood that the relative terms are understood to include a range of 15% (i.e., 15% more, or 15% less) from the stated limitation. Further, such relative terminology is to be analyzed within the scope of the doctrine of equivalents when reviewing the claims (both as presented and as potentially allowed).

The preceding description has been presented only to illustrate and describe exemplary methods and apparatus of the present invention. It is not intended to be exhaustive or to limit the disclosure to any precise form disclosed. Many modifications and variations are possible in light of the above teaching. It is intended that the scope of the invention be defined by the following claims.

I claim:

1. A crossbow-cocking apparatus comprising:

a mounting bracket adapted to allow the crossbow-cocking apparatus to be mounted to a crossbow;

a securing means configured to hold the mounting bracket to the crossbow;

a cocking cord defined by first and second ends thereof;

a first cocking cord handle and a second cocking cord handle, the first and second cocking cord handles being attached to the respective first and second ends of the cocking cord;

a first cocking cord connector and a second cocking cord connector;

a first leg member and a second leg member, the leg members being supported by the mounting bracket;

a cocking cord connector retraction device comprising:

a first elongate spring member disposed at least partially within the first leg member, the first elongate spring member being attached at a first end thereof to the first cocking cord connector, and at a second end thereof to a first terminal position selected to impart a first tensile force to the first elongate spring member when a first elongating force is applied to the first elongate spring member;

a second elongate spring member disposed at least partially within the second leg member, the second elongate spring member being attached at a first end thereof to the second cocking cord connector, and at a second end thereof to a second terminal position selected to impart a second tensile force to the second elongate spring member when a second elongating force is applied to the second elongate spring member;

the first cocking cord connector includes a first cocking cord connector spindle which supports rotation of the cocking cord about the first cocking cord connector spindle, the first cocking cord connector and the first cocking cord connector spindle defining a first cocking cord opening sized to allow the cocking cord to move freely there-through;

the second cocking cord connector includes a second cocking cord connector spindle which supports rotation of the cocking cord about the second cocking cord connector spindle, the second cocking cord connector and the first cocking cord connector spindle defining a second cocking cord opening sized to allow the cocking cord to move freely there-through;

each cocking cord connector includes a cocking hook member configured to engage a bowstring; and the cocking cord passes through the first and second cocking cord openings in the respective first and second cocking cord connectors.

2. The crossbow-cocking apparatus of claim 1 wherein the first and second elongate spring members are respective first and second elasticized cords.

3. The crossbow-cocking apparatus of claim 2 wherein each leg member includes a hollow tubing segment defined by first and second open ends, and:

the first end of each elasticized cord issues from the first open end of a respective hollow tubing segment; and the terminal position of the second end of each elasticized cord is located at the second open end of the respective hollow tubing segment.

4. The crossbow-cocking apparatus of claim 3 wherein:

each cocking cord connector is defined by a first, inward-facing, side and a second, outward-facing, side;

each elasticized cord exits the respective leg member at a location proximate the first, inward-facing side of the respective cocking cord connector;

the first end of each retraction cord is anchored to the respective cocking cord connector proximate the second, outward-facing, side thereof; and each elasticized cord is placed under tension to thus draw the cocking cord connectors inwards.

5. The crossbow-cocking apparatus of claim 1 wherein the mounting bracket includes first and second leg hinge members which support the respective first and second leg members on the mounting bracket.

6. The crossbow-cocking apparatus of claim 5 wherein each leg member includes a generally straight leg segment and a curvilinear leg segment, and each curvilinear leg segment is oriented at an angle of between about 75 degrees and 120 degrees from the respective generally straight leg segment.

7. The crossbow-cocking apparatus of claim 6 wherein the leg hinge members allow the leg members to be rotated from a stored position to a deployed position, and when the crossbow-cocking apparatus is mounted to the crossbow and the leg members are in the stored position, the leg members are generally parallel to limbs of the crossbow.

8. The crossbow-cocking apparatus of claim 7 wherein the second end of each elasticized cord is anchored at the second open end of the respective hollow tubing segment by a knot in the second end of the elasticized cord, and each leg member further comprises a cap which fits over the knot in the second end of the associated elasticized cord and covers the second open end of the hollow tubing segment of the respective leg member.

9. The crossbow-cocking apparatus of claim 5 further comprising first and second leg member tensioning devices configured to variably tighten or loosen the respective leg members within the respective leg hinge members.

10. A bow-cocking apparatus, comprising:

a cocking cord defined by first and second ends thereof;

a first cocking cord handle and a second cocking cord handle, the first and second cocking cord handles being attached to the respective first and second ends of the cocking cord;

a first cocking cord connector and a second cocking cord connector;

an elongate spring member being anchored at a first end thereof to the first cocking cord connector, and at a second end thereof to the second cocking cord connector;

each cocking cord connector includes a cocking cord connector spindle which supports rotation of the cocking cord about the respective cocking cord connector spindle, each cocking cord connector and each respective cocking cord connector spindle defining a cocking cord opening sized to allow the cocking cord to move freely there-through;

each cocking cord connector includes a cocking hook member configured to engage a bowstring; and the cocking cord passes through the first and second cocking cord openings in the respective first and second cocking cord connectors.

11. The bow-cocking apparatus of claim 10 and further comprising a mounting bracket adapted to allow the crossbow-cocking apparatus to be mounted to a crossbow, the mounting bracket including retraction cord retaining clips which support the elongate spring member on the mounting bracket, the retraction cord retaining clips defining retraction cord openings which allow the retraction cord to move freely there-through.

12. The bow-cocking apparatus of claim 11 and further comprising a securing means configured to hold the mounting bracket to the crossbow.

13. The bow-cocking apparatus of claim 11 and further comprising:

a first leg member and a second leg member;

and wherein:

the mounting bracket further comprises first and second leg hinge members which support the respective first and second leg members on the mounting bracket.

14. The bow-cocking apparatus of claim 13 and wherein each leg member includes a generally straight leg segment and a curvilinear leg segment, and each curvilinear leg segment is oriented at an angle of between about 75 degrees and 120 degrees from the respective generally straight leg segment.

15. The bow-cocking apparatus of claim 14 and further comprising first and second leg member tensioning devices which can be used to variably tighten or loosen the respective leg members within the respective leg hinge members.

16. The bow-cocking apparatus of claim 14 and wherein the leg hinge members allow the leg members to be rotated from a stored position to a deployed position, and when the crossbow-cocking apparatus is mounted to the crossbow and the leg members are in the stored position, the generally straight leg segment of each leg member is generally parallel to limbs of the crossbow.

17. The bow-cocking apparatus of claim 10 and wherein:

each cocking cord connector is defined by a first, inward-facing, side and a second, outward-facing, side;

the first end of the elongate spring member is anchored to the first cocking cord connector proximate the second, outward-facing, side thereof;

the second end of the elongate spring member is anchored to the second cocking cord connector proximate the second, outward-facing, side thereof; and the elongate spring member is placed under tension to thus draw the cocking cord connectors inwards.

18. The bow-cocking apparatus of claim 10 and further comprising a hollow, elongated, generally "U" shaped elongate spring member housing defining first and second open ends thereof, and wherein the elongate spring member is disposed within the retraction cord housing with the first and second ends of the elongate spring member issuing from the respective first and second open ends of the retraction cord housing.

19. The bow-cocking apparatus of claim 18 and further comprising a mounting bracket, and wherein the retraction cord housing is attached to the mounting bracket.

20. A crossbow comprising the bow-cocking apparatus of claim 10.

* * * * *